US009046797B2

(12) United States Patent
Fujii et al.

(10) Patent No.: US 9,046,797 B2
(45) Date of Patent: Jun. 2, 2015

(54) PROCESS FOR PRODUCING ELECTROPHOTOGRAPHIC PHOTOSENSITIVE MEMBER

(75) Inventors: Atsushi Fujii, Yokohama (JP); Hideaki Matsuoka, Mishima (JP); Haruyuki Tsuji, Yokohama (JP); Nobuhiro Nakamura, Mishima (JP); Kazuhisa Shida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/983,994

(22) PCT Filed: Mar. 1, 2012

(86) PCT No.: PCT/JP2012/055885

§ 371 (c)(1),
(2), (4) Date: Aug. 6, 2013

(87) PCT Pub. No.: WO2012/118229

PCT Pub. Date: Sep. 7, 2012

(65) Prior Publication Data

US 2013/0316283 A1 Nov. 28, 2013

(30) Foreign Application Priority Data

Mar. 3, 2011 (JP) ..... 2011-046518
Sep. 29, 2011 (JP) ..... 2011-215135
Feb. 24, 2012 (JP) ..... 2012-039026

(51) Int. Cl.
*G03G 5/00* (2006.01)
*G03G 7/00* (2006.01)
(Continued)

(52) U.S. Cl.
CPC ..... *G03G 7/0053* (2013.01); *G03G 5/0507* (2013.01); *G03G 5/0525* (2013.01); *G03G 5/10* (2013.01); *G03G 5/104* (2013.01); *G03G 5/144* (2013.01); *G03G 5/142* (2013.01)

(58) Field of Classification Search
CPC ..... G03G 5/0525; G03G 5/0507
USPC ..... 430/133, 56
See application file for complete search history.

(56) References Cited

U.S. PATENT DOCUMENTS 5,357,320 A 10/1994 Kashimura et al.
(Continued)

FOREIGN PATENT DOCUMENTS

JP 6-207118 A 7/1994
(Continued)

OTHER PUBLICATIONS

PCT International Search Report and Written Opinion of the International Searching Authority, International Application No. JP2012/055885, Mailing Date May 22, 2012.
(Continued)

*Primary Examiner* — Mark A Chapman
(74) *Attorney, Agent, or Firm* — Fitzpatrick, Cella, Harper and Scinto

(57) ABSTRACT

To provide a process for producing an electrophotographic photosensitive member that can not easily cause any fog due to an increase in dark attenuation, a conductive layer is formed with use of a coating liquid for conductive layer prepared with use of a solvent, a binder material and metal oxide particles. The metal oxide particles (P) and binder material (B) in the coating liquid for conductive layer are in a mass ratio (P/B) of from 1.5/1.0 to 3.5/1.0. The metal oxide particle is a titanium oxide particle coated with tin oxide doped with phosphorus or tungsten. Where powder resistivity of the metal oxide particle is represented by x (Ω·cm) and powder resistivity of the titanium oxide particle as a core particle constituting the metal oxide particle is represented by y (Ω·cm), the y and the x satisfy the following relations (i) and (ii):

$$5.0\times10^{7}\leq y\leq5.0\times10^{9} \quad \text{(i)}$$

$$1.0\times10^{2}\leq y/x\leq1.0\times10^{6} \quad \text{(ii).}$$

5 Claims, 1 Drawing Sheet

(51) Int. Cl.

| | |
|---|---|
| ***G03G 5/10*** | (2006.01) |
| ***G03G 5/14*** | (2006.01) |
| *G03G 5/05* | (2006.01) |

(56) References Cited

U.S. PATENT DOCUMENTS

| | | | |
|---|---|---|---|
| 5,385,797 | A | 1/1995 | Nagahara et al. |
| 5,422,210 | A | 6/1995 | Maruyama et al. |
| 5,455,135 | A | 10/1995 | Maruyama et al. |
| 5,468,584 | A | 11/1995 | Go et al. |
| 5,485,250 | A | 1/1996 | Kashimura et al. |
| 5,488,461 | A | 1/1996 | Go et al. |
| 5,853,936 | A | 12/1998 | Segi et al. |
| 6,156,472 | A | 12/2000 | Segi et al. |
| 6,773,856 | B2 | 8/2004 | Tanaka et al. |
| 7,211,357 | B2 | 5/2007 | Hosoi et al. |
| 7,245,851 | B2 | 7/2007 | Fujii et al. |
| 7,276,318 | B2 | 10/2007 | Fujii et al. |
| 7,333,752 | B2 | 2/2008 | Kawahara et al. |
| 7,407,606 | B2 | 8/2008 | Chiba et al. |
| 7,517,626 | B2 | 4/2009 | Fujii et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 2009/0136256 | A1 | 5/2009 | Nakamura et al. |
| 2012/0114375 | A1 | 5/2012 | Fujii et al. |
| 2012/0121291 | A1 | 5/2012 | Tsuji et al. |
| 2012/0301181 | A1 | 11/2012 | Ogaki et al. |
| 2012/0301182 | A1 | 11/2012 | Anezaki et al. |
| 2013/0202326 | A1 | 8/2013 | Shida et al. |
| 2013/0202327 | A1 | 8/2013 | Murai et al. |
| 2013/0236823 | A1 | 9/2013 | Noguchi et al. |
| 2013/0323632 | A1 | 12/2013 | Fujii et al. |
| 2014/0004452 | A1 | 1/2014 | Sekiya et al. |
| 2014/0004453 | A1 | 1/2014 | Kaku et al. |
| 2014/0004454 | A1 | 1/2014 | Okuda et al. |
| 2014/0023961 | A1 | 1/2014 | Okuda et al. |
| 2014/0023962 | A1 | 1/2014 | Okuda et al. |

FOREIGN PATENT DOCUMENTS

| | | | |
|---|---|---|---|
| JP | 6-208238 | A | 7/1994 |
| JP | 6-222600 | A | 8/1994 |
| JP | 10-186702 | A | 7/1998 |
| JP | 2003-316059 | A | 11/2003 |
| JP | 2004-349167 | A | 12/2004 |
| JP | 2007-47736 | A | 2/2007 |
| WO | 2005/008685 | A1 | 1/2005 |
| WO | 2011/027911 | A1 | 3/2011 |

OTHER PUBLICATIONS

Fujii, et al., U.S. Appl. No. 14/095,955, filed Dec. 3, 2013.

Fujii, et al., U.S. Appl. No. 13/972,688, filed Aug. 21, 2013.

European Search Report dated Aug. 5, 2014 in European Application No. 12752203.5.

PROCESS FOR PRODUCING ELECTROPHOTOGRAPHIC PHOTOSENSITIVE MEMBER

TECHNICAL FIELD

This invention relates to a process for producing an electrophotographic photosensitive member.

BACKGROUND ART

In recent years, research and development are energetically made on electrophotographic photosensitive members (organic electrophotographic photosensitive members) making use of organic photoconductive materials.

The electrophotographic photosensitive member is basically constituted of a support and a photosensitive layer formed on the support. In the present state of affairs, however, various layers are often formed between the support and the photosensitive layer for the purposes of, e.g., covering any defects of the surface of the support, protecting the photosensitive layer from any electrical breakdown, improving its chargeability, improving the blocking of injection of electric charges from the support into the photosensitive layer, and so forth.

Among such layers formed between the support and the photosensitive layer, a layer containing metal oxide particles is known as the layer formed for the purpose of covering any defects on the surface of the support. The layer containing metal oxide particles commonly has a higher electrical conductivity than a layer not containing any metal oxide particles (e.g., $1.0\times10^8$ to $5.0\times10^{12}$ Ω·cm as volume resistivity). Thus, even where the layer is formed in a large layer thickness, any residual potential at the time of image formation can not easily come to increase. Hence, any defects of the support surface can be covered with ease.

The covering of defects of the support surface by providing between the support and the photosensitive layer such a layer having a higher electrical conductivity (hereinafter "conductive layer") makes the support surface have a great tolerance for its defects. As the results, this makes the support have a vastly great tolerance for its use, and hence brings an advantage that the electrophotographic photosensitive member can be improved in productivity.

PTL 1 discloses a technique in which tin oxide particles doped with phosphorus are used in an intermediate layer formed between the support and the photosensitive layer. PTL 2 also discloses a technique in which tin oxide particles doped with tungsten are used in a protective layer formed on the photosensitive layer. PTL 3 still also discloses a technique in which titanium oxide particles coated with oxygen deficient tin oxide are used in a conductive layer formed between the support and the photosensitive layer. PTL 4 still also discloses a technique in which barium sulfate particles coated with tin oxide are used in an intermediate layer formed between the support and the photosensitive layer.

CITATION LIST

Patent Literature

PTL 1: Japanese Patent Application Laid-open No. H06-222600

PTL 2: Japanese Patent Application Laid-open No. 2003-316059

PTL 3: Japanese Patent Application Laid-open No. 2007-047736

PTL 4: Japanese Patent Application Laid-open No. H06-208238

SUMMARY OF INVENTION

Technical Problem

However, studies made by the present inventors have revealed that fog comes to tend to occur due to an increase in dark attenuation when images are repeatedly formed in a high-temperature and high-humidity environment by using an electrophotographic photosensitive member employing as the conductive layer any layer containing such metal oxide particles as the above.

An object of the present invention is to provide a process for producing an electrophotographic photosensitive member that can not easily cause such fog due to an increase in dark attenuation even where it is an electrophotographic photosensitive member employing as the conductive layer the layer containing metal oxide particles.

Solution to Problem

The present invention is a process for producing an electrophotographic photosensitive member; the process comprising:

- the step of forming on a support a conductive layer having a volume resistivity of from $1.0\times10^8$ Ω·cm or more to $5.0\times10^{12}$ Ω·cm or less, and
- the step of forming a photosensitive layer on the conductive layer, wherein;
- the step of forming the conductive layer comprises:
- the step of preparing a coating liquid for the conductive layer with use of a solvent, a binder material and metal oxide particles, and
- the step of forming the conductive layer with use of the coating liquid for conductive layer;
- the metal oxide particle (P) and binder material (B) in the coating liquid for the conductive layer are in a mass ratio (P/B) of from 1.5/1.0 to 3.5/1.0;
- the metal oxide particle is a titanium oxide particle coated with tin oxide doped with phosphorus or a titanium oxide particle coated with tin oxide doped with tungsten; and
- where powder resistivity of the metal oxide particle is represented by x (Ω·cm) and powder resistivity of the titanium oxide particle as a core particle constituting the metal oxide particle is represented by y (Ω·cm), the y and the x satisfy the following relations (i) and (ii):

$$5.0\times10^7 \le y \le 5.0\times10^9 \quad \text{(i)}$$

$$1.0\times10^2 \le y/x \le 1.0\times10^6 \quad \text{(ii)}$$

Advantageous Effects of Invention

According to the present invention, an electrophotographic photosensitive member can be produced which can not easily cause any fog due to an increase in dark attenuation even where it is an electrophotographic photosensitive member employing as the conductive layer the layer containing metal oxide particles.

Further features of the present invention will become apparent from the following description of exemplary embodiments with reference to the attached drawings.

DESCRIPTION OF EMBODIMENTS

The present invention is a process for producing an electrophotographic photosensitive member, and has the step of forming on a support a conductive layer having a volume resistivity of from $1.0\times10^{8}$ Ω·cm or more to $5.0\times10^{12}$ Ω·cm or less and the step of forming a photosensitive layer on the conductive layer. The electrophotographic photosensitive member produced by the production process of the present invention is an electrophotographic photosensitive member having a support, a conductive layer formed on the support, and a photosensitive layer formed on the conductive layer.

The photosensitive layer may be a single-layer type photosensitive layer which contains a charge-generating material and a charge-transporting material in a single layer, or may be a multi-layer type photosensitive layer formed in layers of a charge generation layer which contains a charge-generating material and a charge transport layer which contains a charge-transporting material. An undercoat layer may also optionally be provided between the conductive layer formed on the support and the photosensitive layer.

As the support, it may preferably be one having electrical conductivity (a conductive support). For example, a metallic support may be used which is made of a metal, formed of a metal such as aluminum, an aluminum alloy or stainless steel. Where aluminum or an aluminum alloy is used, usable are an aluminum pipe produced by a production process having the step of extrusion and the step of drawing, and an aluminum pipe produced by a production process having the step of extrusion and the step of ironing. Such aluminum pipes can achieve a good dimensional precision and surface smoothness without requiring any surface cutting and besides are advantageous in view of cost as well. However, burr-like protruding defects tend to come on the surfaces of these non-cut aluminum pipes, and hence it is especially effective to provide the conductive layer.

In the present invention, for the purpose of covering any defects of the surface of the support, the conductive layer having a volume resistivity of from $1.0\times10^{8}$ Ω·cm or more to $5.0\times10^{12}$ Ω·cm or less is provided on the support. If a layer having a volume resistivity of more than $5.0\times10^{12}$ Ω·cm is provided on the support as the layer for covering any defects of the surface of the support, the flow of electric charges comes to tend to stagnate therein when images are formed, to come to tend to increase in residual potential. If on the other hand the conductive layer has a volume resistivity of less than $1.0\times10^{8}$ Ω·cm, the electric charges flowing through the conductive layer may be so excessively large in quantity when the electrophotographic photosensitive member is charged that the fog due to an increase in dark attenuation of the electrophotographic photosensitive member may come to tend to occur.

Figure 2:
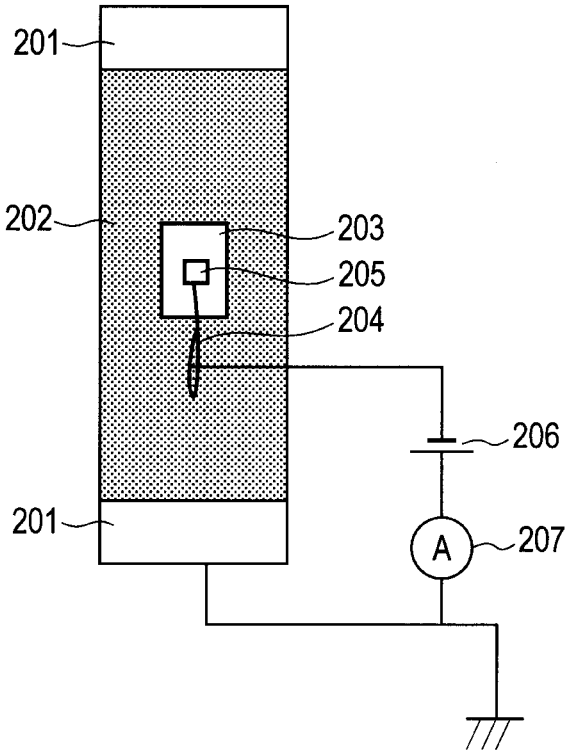
FIG. 2 is a view (plan view) to illustrate how to measure the volume resistivity of a conductive layer.
Figure 3:
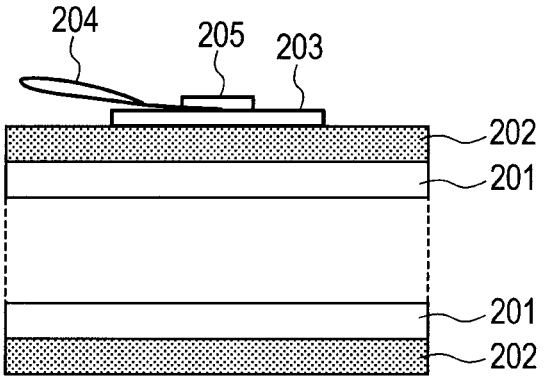
FIG. 3 is a view (sectional view) to illustrate how to measure the volume resistivity of a conductive layer.

How to measure the volume resistivity of the conductive layer of the electrophotographic photosensitive member is described below with reference to FIGS. 2 and 3. FIG. 2 is a plan view to illustrate how to measure the volume resistivity of the conductive layer, and FIG. 3 is a sectional view to illustrate how to measure the volume resistivity of the conductive layer.

The volume resistivity of the conductive layer is measured in a normal-temperature and normal-humidity (23° C./50% RH) environment. A tape 203 made of copper (Type No. 1181, available from Sumitomo 3M Limited) is stuck to the surface of a conductive layer 202 to make it serve as an electrode on the surface side of the conductive layer 202. A support 201 is also made to serve as an electrode on the back side of the conductive layer 202. A power source 206 and a current measuring instrument 207 are respectively set up; the former for applying voltage across the copper tape 203 and the support 201 and the latter for measuring electric current flowing across the copper tape 203 and the support 201.

To make the voltage applicable to the copper tape 203, a copper wire 204 is put on the copper tape 203, and then a tape 205 made of copper like the copper tape 203 is stuck from above the copper wire 204 to the copper tape 203 so that the copper wire 204 may not protrude from the copper tape 203, to fasten the copper wire 204 to the copper tape 203. To the copper tape 203, voltage is applied through the copper wire 204.

A background current value found when any voltage is not applied across the copper tape 203 and the support 201 is represented by $I_0$ (A), a current value found when a voltage of −1 V having only a direct-current component is applied across the copper tape 203 and the support 201 is represented by I (A), the layer thickness of the conductive layer 202 is represented by d (cm) and the area of the electrode (copper tape 203) on the surface side of the conductive layer 202 is represented by S ($cm^2$), where the value expressed by the following mathematical expression (1) is taken as volume resistivity ρ (Ω·cm) of the conductive layer 202.

$$\rho=1/(I-I_0)\times S/d\ (\Omega\cdot\text{cm}) \quad (1)$$

In this measurement, the level of electric current of extremely as extremely small as $1\times10^{6}$ A or less as absolute value is measured, and hence it is preferable to make the measurement by using as the current measuring instrument 207 an instrument that can measure an extremely small electric current. Such an instrument may include, e.g., a pA meter (trade name: 4140B) manufactured by Yokogawa Hewlett-Packard Company.

Incidentally, the volume resistivity of the conductive layer shows the like value in either of measurement made in the state only the conductive layer has been formed on the support and measurement made in the state the respective layers (photosensitive layer and so forth) on the conductive layer have been stripped off the electrophotographic photosensitive member so as to leave only the conductive layer on the support.

In the present invention, the conductive layer is formed by using a coating liquid for conductive layer prepared with use of a solvent, a binder material and metal oxide particles. The coating liquid for conductive layer may be prepared by dispersing the metal oxide particles in the solvent together with the binder material. As a method for dispersion, it may include, e.g., a method making use of a paint shaker, a sand mill, a ball mill or a liquid impact type high-speed dispersion machine. The conductive layer may be formed by applying the coating liquid for conductive layer, thus prepared, onto the support and then drying and/or curing the wet coating formed.

In the present invention, as the metal oxide particles, titanium oxide ($TiO_2$) particles coated with tin oxide ($SnO_2$) doped with phosphorus (P) or titanium oxide ($TiO_2$) particles coated with tin oxide ($SnO_2$) doped with tungsten (W) are used. These are hereinafter generically termed also "tin oxide coated titanium oxide particles".

The tin oxide coated titanium oxide particles used in the present invention are particles having been made to have a powder resistivity x (Ω·cm) by coating titanium oxide ($TiO_2$) particles [(particles composed of only titanium oxide ($TiO_2$)] having a powder resistivity y (Ω·cm), with tin oxide ($SnO_2$) doped with phosphorus (P) or tungsten (W), where the y and the x satisfy the following relations (i) and (ii):

$$5.0\times10^7 \leq y \leq 5.0\times10^9 \quad \text{(i)}$$

$$1.0\times10^2 \leq y/x \leq 1.0\times10^6 \quad \text{(ii)}$$

In other words, where powder resistivity of the tin oxide coated titanium oxide particles used in the present invention is represented by x (Ω·cm) and powder resistivity of the titanium oxide ($TiO_2$) particles that are core particles constituting the tin oxide coated titanium oxide particles used in the present invention is represented by y (Ω·cm), the y and the x satisfy the above relations (i) and (ii).

If the core particles titanium oxide ($TiO_2$) particles constituting the tin oxide coated titanium oxide particles has a powder resistivity y of less than $5.0\times10^7$ Ω·cm, the fog due to an increase in dark attenuation of the electrophotographic photosensitive member comes to tend to occur. This is because, in addition to the coats (also "coat layers") [i.e., the part of the tin oxide ($SnO_2$) doped with phosphorus (P) or tungsten (W)] that originally tend to flow electric current therethrough, even the core particles [the titanium oxide ($TiO_2$) particles] covered with such coats has a low powder resistivity y, and hence the electric charges flowing through not only the coats but also the core particles tends to become large in quantity when the electrophotographic photosensitive member is charged, as so considered. That is, it is because the electric charges come to more tend to flow at the time of charging of the electrophotographic photosensitive member at which the quantity of electric charges flowing through the electrophotographic photosensitive member should be controlled or limited. The powder resistivity y may preferably be $1.0\times10^8$ or more ($1.0\times10^8 \leq y$).

On the other hand, if the core particle titanium oxide ($TiO_2$) particle constituting the tin oxide coated titanium oxide particles has a powder resistivity y of more than $5.0\times10^9$ Ω·cm, the residual potential comes to tend to increase. This is because the core particles [the titanium oxide ($TiO_2$) particles] has a high powder resistivity y, and hence the electric charges flowing through the core particles may inevitably become small in quantity at the time of exposure, so that it may come about that the electric charges flow chiefly only at the coats, as so considered. That is, it is because the electric charges come more not to easily flow at the time of exposure at which the quantity of electric charges flowing through the electrophotographic photosensitive member should be made large. The powder resistivity y may preferably be $1.0\times10^9$ or less ($y \leq 1.0\times10^9$).

The value of y/x in the above relation (ii) (hereinafter also "powder resistivity ratio y/x") is a parameter which means that the quantity of electric charges flowing through the core particles titanium oxide ($TiO_2$) particles constituting the tin oxide coated titanium oxide particles and the quantity of electric charges flowing through the whole tin oxide coated titanium oxide particles inclusive of the coats are required to be balanced with each other within a specific range.

If the powder resistivity ratio y/x is more than $1.0\times10^6$, the fog due to an increase in dark attenuation of the electrophotographic photosensitive member comes to tend to occur. This is caused by the fact that any high powder resistivity ratio y/x makes the balance between the quantity of electric charges flowing through the core particles titanium oxide ($TiO_2$) particles constituting the tin oxide coated titanium oxide particles and the quantity of electric charges flowing through the whole tin oxide coated titanium oxide particles break when the electrophotographic photosensitive member is charged, as so considered. That is, it is because the electric charges come to tend to flow locally at the coats at the time of charging of the electrophotographic photosensitive member at which the quantity of electric charges flowing through the electrophotographic photosensitive member should be controlled or limited.

On the other hand, if the powder resistivity ratio y/x is less than $1.0\times10^2$, the residual potential comes to tend to increase. This is caused by the fact that any low powder resistivity ratio y/x makes the balance between the quantity of electric charges flowing through the core particles titanium oxide ($TiO_2$) particles constituting the tin oxide coated titanium oxide particles and the quantity of electric charges flowing through the whole tin oxide coated titanium oxide particles break when the electrophotographic photosensitive member is charged, as so considered. That is, it is because the electric charges come not to easily flow through the coats at the time of exposure at which the quantity of electric charges flowing through the electrophotographic photosensitive member should be made large.

For the above reasons, the powder resistivity ratio y/x is required to be from $1.0\times10^2$ or more to $1.0\times10^6$ or less. A preferable powder resistivity ratio y/x may be from $1.0\times10^3$ or more to $1.0\times10^5$ or less, i.e.:

$$1.0\times10^3 \leq y/x \leq 1.0\times10^5 \quad \text{(iii).}$$

The titanium oxide ($TiO_2$) particles coated with tin oxide ($SnO_2$) doped with phosphorus (P) or tungsten (W) [in particular, phosphorus (P)] as used in the present invention are more greatly effective in keeping the fog due to an increase in dark attenuation of the electrophotographic photosensitive member from occurring, and also more greatly effective in keeping the residual potential from increasing when images are formed, than any titanium oxide ($TiO_2$) particles coated with oxygen deficient tin oxide ($SnO_2$).

Details are unclear about the reason why the former particles are greatly effective in keeping the fog due to an increase in dark attenuation from occurring, which, however, is considered to be concerned with the fact that the use of the titanium oxide ($TiO_2$) particles coated with tin oxide ($SnO_2$) doped with phosphorus (P) or tungsten (W) [in particular, phosphorus (P)] makes small the electric current (dark electric current) flowing through the electrophotographic photosensitive member at its dark areas when a stated voltage is applied thereto.

About the reason why the former particles are greatly effective in keeping the residual potential from increasing when images are formed, it is considered due to the fact that the latter titanium oxide ($TiO_2$) particles coated with oxygen deficient tin oxide ($SnO_2$) come oxidized in the presence of oxygen to lose their oxygen deficient portions, so that the latter particles may come to have a high resistance to make the flow of electric charges come to tend to stagnate in the conductive layer, whereas the former particles according to the present invention are not so.

The core particles titanium oxide ($TiO_2$) particles constituting the tin oxide coated titanium oxide particles used in the present invention may have a particle shape which is granular, spherical, acicular, fibrous, columnar, rod-like, spindle-like or plate-like, or other similar shape, any of which may be used. From the viewpoint of less image defects such as black spots, spherical particles are preferred. The core particles titanium oxide ($TiO_2$) particles constituting the tin oxide coated titanium oxide particles may also have a crystal form of rutile, anatase, brookite or amorphous, any crystal form of which may be used. As to their production method as well, any production method may be used, such as a sulfuric acid method or a hydrochloric acid method.

The tin oxide ($SnO_2$) in the tin oxide coated titanium oxide particles may preferably be in a proportion (coverage) of from 10% by mass to 60% by mass. To control the coverage of the tin oxide ($SnO_2$), a tin raw material necessary for formation of the tin oxide ($SnO_2$) must be compounded when the tin oxide coated titanium oxide particles are produced. For example, where tin chloride ($SnCl_4$) that is a tin raw material is used, it must be formulated taking account of the amount of the tin oxide ($SnO_2$) to be formed from the tin chloride ($SnCl_4$).

Here, the tin oxide ($SnO_2$) serving as the coats of the tin oxide coated titanium oxide particles used in the present invention stands doped with phosphorus (P) or tungsten (W), where the coverage is defined as the value found by calculation from the mass of the tin oxide ($SnO_2$) with respect to the total mass of the tin oxide ($SnO_2$) and titanium oxide ($TiO_2$), without taking account of the mass of the phosphorus (P) or tungsten (W) with which the tin oxide ($SnO_2$) stands doped.

Any tin oxide ($SnO_2$) in a coverage of less than 10% by mass makes it difficult to control the powder resistivity ratio y/x to be from $1.0\times10^2$ or more to $1.0\times10^6$ or less. Any tin oxide ($SnO_2$) in a coverage of more than 60% by mass tends to make non-uniform the covering of the titanium oxide ($TiO_2$) with the tin oxide ($SnO_2$), and tends to result in a high cost.

The phosphorus (P) or tungsten (W) with which the tin oxide ($SnO_2$) is doped may preferably be in an amount of from 0.1% by mass to 10% by mass based on the mass of the tin oxide ($SnO_2$) [the mass not inclusive of the phosphorus (P) or tungsten (W)]. Any phosphorus (P) or tungsten (W) with which the tin oxide ($SnO_2$) is doped in an amount of less than 0.1% by mass makes it difficult to control the powder resistivity ratio y/x to be from $1.0\times10^2$ or more to $1.0\times10^6$ or less. Any phosphorus (P) or tungsten (W) with which the tin oxide ($SnO_2$) is doped in an amount of more than 10% by mass makes the tin oxide ($SnO_2$) low crystallizable, and makes it difficult to control the powder resistivity ratio y/x to be from $1.0\times10^2$ or more to $1.0\times10^6$ or less. The doping of the tin oxide ($SnO_2$) with the phosphorus (P) or tungsten (W) can commonly make the tin oxide coated titanium oxide particles have a lower powder resistivity than those not doped therewith.

Incidentally, how to produce the titanium oxide ($TiO_2$) particles coated with tin oxide ($SnO_2$) doped with phosphorus (P) and the titanium oxide ($TiO_2$) particles coated with tin oxide ($SnO_2$) doped with tungsten (W) is also disclosed in Japanese Patent Applications Laid-open No. H06-207118 and No. 2004-349167.

How to measure the powder resistivity of the metal oxide particles (tin oxide coated titanium oxide particles) is as described below.

The powder resistivity of the metal oxide particles (tin oxide coated titanium oxide particles) and that of the core particles [titanium oxide ($TiO_2$) particles] constituting the metal oxide particles are measured in a normal-temperature and normal-humidity (23° C./50% RH) environment. In the present invention, a resistivity measuring instrument manufactured by Mitsubishi Chemical Corporation [trade name: LORESTA GP (or HIRESTA UP in the case of more than $10^7$ Ω·cm)] is used as a measuring instrument. The measurement object metal oxide particles (tin oxide coated titanium oxide particles) and so forth are each compacted at a pressure of 500 $kg/cm^2$ to prepare a pellet-shaped measuring sample. The powder resistivity is measured at an applied voltage of 100 V.

In the present invention, the tin oxide coated titanium oxide particles having the core particles [titanium oxide ($TiO_2$) particles] are used as the metal oxide particles incorporated in the conductive layer, which are used in order to achieve an improvement in the dispersibility of the metal oxide particles in the coating liquid for conductive layer. Any use of particles composed of only the tin oxide ($SnO_2$) doped with phosphorus (P) or tungsten (W) or the oxygen deficient tin oxide ($SnO_2$) tends to make the metal oxide particles have a large particle diameter in the coating liquid for conductive layer, so that protrusive seeding defects may occur on the surface of the conductive layer and also the coating liquid for conductive layer may have a low stability.

The titanium oxide ($TiO_2$) particles are used as the core particles, which are used because they are greatly effective in keeping the fog due to an increase in dark attenuation of the electrophotographic photosensitive member from occurring. Details are unclear about the reason why such particles are greatly effective in keeping the fog due to an increase in dark attenuation from occurring, which, however, is considered to be concerned with the fact that their use makes small the electric current (dark electric current) flowing through the electrophotographic photosensitive member at its dark areas when a stated voltage is applied thereto. Further, the titanium oxide ($TiO_2$) particles as the core particles have an advantage that they are so low transparent as the metal oxide particles as to easily cover any defects of the surface of the support. In contrast thereto, where, e.g., barium sulfate particles are used as the core particles, they are so high transparent as the metal oxide particles as to make it necessary to specially use a material for covering any defects of the surface of the support.

Not any uncoated titanium oxide ($TiO_2$) particles, but the titanium oxide ($TiO_2$) particles coated with tin oxide ($SnO_2$) doped with phosphorus (P) or tungsten (W) are used as the metal oxide particles, which are used because such uncoated titanium oxide ($TiO_2$) particles make the flow of electric charges come to tend to stagnate when images are formed, and come to tend to result in an increase in residual potential, whereas the latter particles according to the present invention are not so.

As the binder material used in preparing the coating liquid for conductive layer, it may include, e.g., resins such as phenol resin, polyurethane resin, polyamide resin, polyimide resin, polyamide-imide resin, polyvinyl acetal resin, epoxy resin, acrylic resin, melamine resin and polyester resin. Any of these may be used alone or in combination of two or more types. Also, of these, from the viewpoints of control of migration (transfer) to other layers, adhesion to the support, dispersibility and dispersion stability of the tin oxide coated titanium oxide particles and solvent resistance after layer formation, hardening resins are preferred, and heat-hardening resins (thermosetting resins) are much preferred. Still also, of the thermosetting resins, thermosetting phenol resins and thermosetting polyurethane resins are preferred. Where such a hardening resin is used as the binder material for the conductive layer, the binder material to be contained in the coating liquid for conductive layer serves as a monomer, and/or an oligomer, of the hardening resin.

The solvent used in preparing the coating liquid for conductive layer may include, e.g., alcohols such as methanol, ethanol and isopropanol; ketones such as acetone, methyl ethyl ketone and cyclohexanone; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene.

In the present invention, the metal oxide particles (tin oxide coated titanium oxide particles) (P) and binder material (B) in the coating liquid for conductive layer are required to be in a mass ratio (P/B) of from 1.5/1.0 to 3.5/1.0. If the metal oxide particles (tin oxide coated titanium oxide particles) (P) and the binder material (B) are in a mass ratio (P/B) of less than 1.5/1.0, the flow of electric charges comes to tend to stagnate in the conductive layer when images are formed, to come to tend to increase in residual potential. Also, those in such a ratio make it difficult to control the volume resistivity of the conductive layer to be $5.0\times10^{12}$ Ω·cm or less. If the metal oxide particles (tin oxide coated titanium oxide particles) (P) and the binder material (B) are in a mass ratio (P/B) of more than 3.5/1.0, this makes it difficult to control the volume resistivity of the conductive layer to be $1.0\times10^{8}$ Ω·cm or more, and also makes it difficult to bind the metal oxide particles (tin oxide coated titanium oxide particles), to come to tend to cause cracks in the conductive layer and come to tend to cause the fog due to an increase in dark attenuation.

From the viewpoint of covering any defects of the surface of the support, the conductive layer may preferably have a layer thickness of from 10 μm or more to 40 μm or less, and much preferably from 15 μm or more to 35 μm or less.

In the present invention, the layer thickness of each layer, inclusive of the conductive layer, of the electrophotographic photosensitive member is measured with FISCHERSCOPE Multi Measurement System (MMS), available from Fischer Instruments Co.

The tin oxide coated titanium oxide particles in the coating liquid for conductive layer may preferably have an average particle diameter of from 0.10 μm or more to 0.45 μm or less, and much preferably from 0.15 μm or more to 0.40 μm or less. If the tin oxide coated titanium oxide particles have an average particle diameter of less than 0.10 μm, such tin oxide coated titanium oxide particles may come to agglomerate again after the coating liquid for conductive layer has been prepared, to make the coating liquid for conductive layer low stable or cause cracks in the surface of the conductive layer. If the tin oxide coated titanium oxide particles have an average particle diameter of more than 0.45 μm, the surface of the conductive layer may come so rough as to come to tend to cause local injection of electric charges therefrom into the photosensitive layer, so that black dots may come to conspicuously appear in white background areas of reproduced images.

The average particle diameter of the tin oxide coated titanium oxide particles in the coating liquid for conductive layer may be measured by liquid-phase sedimentation in the following way.

First, the coating liquid for conductive layer is so diluted with the solvent used in preparing the same, as to have a transmittance between 0.8 and 1.0. Next, a histogram of average particle diameter (volume base D50) and particle size distribution of the tin oxide coated titanium oxide particles is prepared by using a centrifugal automatic particle size distribution measuring instrument. In the present invention, as the centrifugal automatic particle size distribution measuring instrument, a centrifugal automatic particle size distribution measuring instrument (trade name: CAPA700) manufactured by Horiba, Ltd. is used to make measurement under conditions of a number of revolutions of 3,000 rpm.

As particle diameter of the titanium oxide ($TiO_2$) particles that are the core particles constituting the tin oxide coated titanium oxide particles, it may preferably be from 0.05 μm or more to 0.40 μm or less, from the viewpoint of controlling the average particle diameter of the tin oxide coated titanium oxide particles within the above range.

In order to keep interference fringes from appearing on reproduced images because of interference of light having reflected from the surface of the conductive layer, a surface roughness providing material for roughening the surface of the conductive layer may also be added to the coating liquid for conductive layer. Such a surface roughness providing material may preferably be resin particles having an average particle diameter of from 1 μm or more to 5 μm or less. Such resin particles may include, e.g., particles of hardening rubbers and of hardening resins such as polyurethane, epoxy resin, alkyd resin, phenol resin, polyester, silicone resin and acryl-melamine resin. Of these, particles of silicone resin are preferred as being not easily agglomerative. The specific gravity of resin particles (which is 0.5 to 2) is smaller than the specific gravity of the tin oxide coated titanium oxide particles (which is 4 to 7), and hence the surface of the conductive layer can efficiently be roughened at the time of formation of the conductive layer. However, the conductive layer has a tendency to increase in volume resistivity with an increase in content of the surface roughness providing material in the conductive layer. Hence, in order to control the volume resistivity of the conductive layer to be $5.0\times10^{12}$ Ω·cm or less, the content of the surface roughness providing material in the coating liquid for conductive layer may preferably be from 1 to 80% by mass based on the mass of the binder material in the coating liquid for conductive layer.

To the coating liquid for conductive layer, a leveling agent may also be added in order to enhance the surface properties of the conductive layer. Pigment particles may also be added to the coating liquid for conductive layer in order to improve covering properties of the conductive layer.

Between the conductive layer and the photosensitive layer, an undercoat layer (a barrier layer) having electrical barrier properties may be provided in order to block the injection of electric charges from the conductive layer into the photosensitive layer.

The undercoat layer may be formed by coating on the conductive layer a coating liquid for undercoat layer containing a resin (binder resin), and drying the wet coating formed.

The resin (binder resin) used for the undercoat layer may include, e.g., water-soluble resins such as polyvinyl alcohol, polyvinyl methyl ether, polyacrylic acids, methyl cellulose, ethyl cellulose, polyglutamic acid, casein, and starch; and polyamide, polyimide, polyamide-imide, polyamic acid, melamine resin, epoxy resin, polyurethane, and polyglutamate. Of these, in order to bring out the electrical barrier properties of the undercoat layer effectively, thermoplastic resins are preferred. Of the thermoplastic resins, a thermoplastic polyamide is preferred. As the polyamide, copolymer nylon is preferred.

The undercoat layer may preferably have a layer thickness of from 0.1 μm or more to 2 μm or less.

In order to make the flow of electric charges not stagnate in the undercoat layer, the undercoat layer may also be incorporated with an electron-transporting material (an electron-accepting material such as an acceptor). The electron-transporting material may include, e.g., electron-attracting materials such as 2,4,7-trinitrofluorenone, 2,4,5,7-tetranitrofluorenone, chloranil and tetracyanoquinodimethane, and those obtained by polymerizing these electron-attracting materials.

The photosensitive layer is formed on the conductive layer (an undercoat layer).

The charge-generating material used in the photosensitive layer may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, quinacridone pigments, azulenium salt pigments, cyanine dyes, xanthene dyes, quinoneimine dyes, and styryl dyes. Of these, preferred are metal phthalocyanines such as oxytitanium phthalocyanine, hydroxygallium phthalocyanine and chlorogallium phthalocyanine.

In the case when the photosensitive layer is the multi-layer type photosensitive layer, the charge generation layer may be formed by coating a coating liquid for charge generation layer obtained by dispersing the charge generating material in a solvent together with a binder resin, and drying the wet coating formed. As a method for dispersion, a method is available which makes use of, e.g., a homogenizer, ultrasonic waves, a ball mill, a sand mill, an attritor or a roll mill.

The binder resin used to form the charge generation layer may include, e.g., polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, a styrene-butadiene copolymer, alkyd resin, epoxy resin, urea resin, and a vinyl chloride-vinyl acetate copolymer. Any of these may be used alone or in the form of a mixture or copolymer of two or more types.

The charge generating material and the binder resin may preferably be in a proportion (charge generating material: binder resin) ranging from 10:1 to 1:10 (mass ratio), and much preferably from 5:1 to 1:1 (mass ratio).

The solvent used for the coating liquid for charge generation layer may include, e.g., alcohols, sulfoxides, ketones, ethers, esters, aliphatic halogenated hydrocarbons and aromatic compounds.

The charge generation layer may preferably have a layer thickness of 5 μm or less, and much preferably from 0.1 μm or more to 2 μm or less.

To the charge generation layer, a sensitizer, an antioxidant, an ultraviolet absorber, a plasticizer and so forth which may be of various types may also optionally be added. An electron transport material (an electron accepting material such as an acceptor) may also be incorporated in the charge generation layer in order to make the flow of electric charges not stagnate in the charge generation layer. The electron-transporting material may include, e.g., electron-attracting materials such as 2,4,7-trinitrofluorenone, 2,4,5,7-tetranitrofluorenone, chloranil and tetracyanoquinodimethane, and those obtained by polymerizing these electron-attracting materials.

The charge transporting material used in the photosensitive layer may include, e.g., triarylamine compounds, hydrazone compounds, styryl compounds, stilbene compounds, pyrazoline compounds, oxazole compounds, thiazole compounds, and triarylmethane compounds.

In the case when the photosensitive layer is the multi-layer type photosensitive layer, the charge transport layer may be formed by coating a coating liquid for charge transport layer obtained by dissolving the charge transporting material and a binder resin in a solvent, and drying the wet coating formed.

The binder resin used to form the charge transport layer may include, e.g., acrylic resin, styrene resin, polyester, polycarbonate, polyarylate, polysulfone, polyphenylene oxide, epoxy resin, polyurethane, alkyd resin and unsaturated resins. Any of these may be used alone or in the form of a mixture or copolymer of two or more types.

The charge transporting material and the binder resin may preferably be in a proportion (charge transporting material: binder resin) ranging from 2:1 to 1:2 (mass ratio).

The solvent used in the coating liquid for charge transport layer may include, e.g., ketones such as acetone and methyl ethyl ketone, esters such as methyl acetate and ethyl acetate, ethers such as dimethoxymethane and dimethoxyethane, aromatic hydrocarbons such as toluene and xylene, and hydrocarbons substituted with a halogen atom, such as chlorobenzene, chloroform and carbon tetrachloride.

The charge transport layer may preferably have a layer thickness of from 3 μm or more to 40 μm or less, and much preferably from 4 μm or more to 30 μm or less, from the viewpoint of charging uniformity and image reproducibility.

the charge transport layer, an antioxidant, an ultraviolet absorber, a plasticizer and so forth may also optionally be added.

In the case when the photosensitive layer is the single-layer type photosensitive layer, the single-layer type photosensitive layer may be formed by coating a coating liquid for single-layer type photosensitive layer containing a charge generating material, a charge transporting material, a binder resin and a solvent, and drying the wet coating formed. As these charge generating material, charge transporting material, binder resin and solvent, the above various ones may be used.

For the purpose of protecting the photosensitive layer, a protective layer may also be provided on the photosensitive layer. The protective layer may be formed by coating a coating liquid for protective layer containing a resin (binder resin), and drying and/or curing the wet coating formed.

The protective layer may preferably have a layer thickness of from 0.5 μm or more to 10 μm or less, and much preferably from 1 μm or more to 8 μm or less.

When the coating liquids for the above respective layers are coated, usable are coating methods as exemplified by dip coating (immersion coating), spray coating, spinner coating, roller coating, Mayer bar coating and blade coating.

Figure 1:
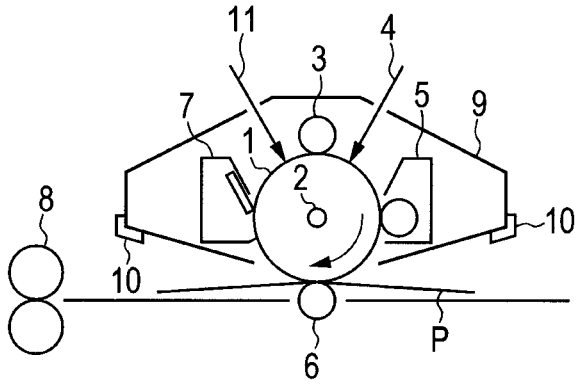
FIG. 1 is a view showing schematically an example of the construction of an electrophotographic apparatus provided with a process cartridge having an electrophotographic photosensitive member.

FIG. 1 schematically shows an example of the construction of an electrophotographic apparatus provided with a process cartridge having the electrophotographic photosensitive member.

In FIG. 1, reference numeral 1 denotes a drum-shaped electrophotographic photosensitive member, which is rotatingly driven around an axis 2 in the direction of an arrow at a stated peripheral speed.

The peripheral surface of the electrophotographic photosensitive member 1 rotatingly driven is uniformly electrostatically charged to a positive or negative, stated potential through a charging device (a primary charging device; e.g., a charging roller) 3. The electrophotographic photosensitive member thus charged is then exposed to exposure light (imagewise exposure light) 4 emitted from an exposing device (an imagewise exposing device; not shown) for slit exposure, laser beam scanning exposure or the like. In this way, electrostatic latent images corresponding to the intended image are successively formed on the peripheral surface of the electrophotographic photosensitive member 1. Voltage to be applied to the charging device 3 may be only direct-current voltage or may be direct-current voltage on which alternating-current voltage is kept superimposed.

The electrostatic latent images thus formed on the peripheral surface of the electrophotographic photosensitive member 1 are developed with a toner of a developing device 5 to form toner images. Then, the toner images thus formed and held on the peripheral surface of the electrophotographic photosensitive member 1 are transferred to a transfer material (such as paper) P by applying a transfer bias from a transferring device (such as a transferring roller) 6. The transfer material P is fed through a transfer material feed device (not shown) to come to the part (contact zone) between the electrophotographic photosensitive member 1 and the transferring device 6 in the manner synchronized with the rotation of the electrophotographic photosensitive member 1.

The transfer material P to which the toner images have been transferred is separated from the peripheral surface of the electrophotographic photosensitive member 1 and is led into a fixing device 8, where the toner images are fixed, and is then printed out of the apparatus as an image-formed material (a print or copy).

The peripheral surface of the electrophotographic photosensitive member 1 from which the toner images have been transferred is brought to removal of the toner remaining after the transfer, through a cleaning device (such as a cleaning blade) 7. It is further subjected to charge elimination by pre-exposure light 11 emitted from a pre-exposure device (not shown), and thereafter repeatedly used for the formation of images. Incidentally, the pre-exposure is not necessarily required where the charging device is a contact charging device such as a charging roller.

The apparatus may be constituted of at least one constituents selected from the above electrophotographic photosensitive member 1, charging device 3, developing device 5, transferring device 6, cleaning device 7 and so forth which are received in a container to set up a process cartridge so that the process cartridge may be set detachably mountable to the main body of an electrophotographic apparatus. In what is shown in FIG. 1, the electrophotographic photosensitive member 1 and the charging device 3, developing device 5 and cleaning device 7 are integrally supported to form a cartridge to set up a process cartridge 9 that is detachably mountable to the main body of the electrophotographic apparatus through a guide device 10 such as rails provided in the main body of the electrophotographic apparatus. The electrophotographic apparatus may also be constituted to have the electrophotographic photosensitive member 1 and the charging device 3, exposing device, developing device 5 and cleaning device 7.

EXAMPLES

The present invention is described below in greater detail by giving specific working examples. The present invention, however, is by no means limited to these. In the following working examples, "part(s)" refers to "part(s) by mass". Core particles titanium oxide ($TiO_2$) particles in the tin oxide coated titanium oxide particles as used in the following working examples are all spherical ones having a BET value of 7.8 $m^2/g$.

Preparation Examples for Coating Liquid for Conductive Layer

Preparation Example for Coating Liquid 1 for Conductive Layer 192 parts of titanium oxide ($TiO_2$) particles coated with tin oxide ($SnO_2$) doped with phosphorus (P) as metal oxide particles (powder resistivity: $5.0\times10^4$ Ω·cm; average primary particle diameter: 250 nm), produced by using titanium oxide ($TiO_2$) particles having a powder resistivity of $5.0\times10^7$ Ω·cm, 168 parts of phenol resin (monomer/oligomer of phenol resin) (trade name: PLYOPHEN J-325; available from Dainippon Ink & Chemicals, Incorporated; resin solid content: 60%) as a binder material and 98 parts of 1-methoxy-2-propanol as a solvent were put into a sand mill making use of 420 parts of glass beads of 0.8 mm in diameter, to carry out dispersion treatment ("dispersing" in Tables 1 and 2) under conditions of a number of revolutions of 1,500 rpm, a dispersion treatment time of 4 hours and a cooling water preset temperature of 18° C. to obtain a liquid dispersion.

After the glass beads were removed from this liquid dispersion through a mesh, 13.8 parts of silicone resin particles (trade name: TOSPEARL 120; available from Momentive Performance Materials Inc.; average particle diameter: 2 μm) as a surface roughness providing material, 0.014 part of silicone oil (trade name: SH28PA; available from Dow Corning Toray Co., Ltd.) as a leveling agent, 6 parts of methanol and 6 parts of 1-methoxy-2-propanol were added to the liquid dispersion, followed by stirring to prepare a coating liquid 1 for conductive layer.

Preparation Examples for Coating Liquids 2 to 68 & C1 to C83 for Conductive Layer Coating liquids 2 to 68 and C1 to C83 for conductive layer were prepared in the same manner as Preparation Example for Coating liquid 1 for conductive layer except that, about the materials used in preparing the coating liquid for conductive layer, the type, powder resistivity and amount (parts) of the metal oxide particles, the powder resistivity of the core particles thereof, the amount of the phenol resin as a binder material and also the dispersion treatment time were each assigned or set as shown in Tables 1 and 2. In Tables 1 and 2, tin oxide is as $SnO_2$ and titanium oxide is as $TiO_2$.

TABLE 1

| | Metal oxide particles (P) | | | | | Binder material (B) (phenol resin) Amount (parts) | | |
|---|---|---|---|---|---|---|---|---|
| Coating liquid for conductive layer | Type | Powder resistivity (x) (Ω · cm) | Amt. (pt) | Powder resistivity of core particles (y) (Ω · cm) | y/x | (resin solid content: 60 ms. % of the fol.) | Dispersing time (h) | P/B in coating liquid for conductive layer |
| 1 | $TiO_2$ | $5.0\times10^4$ | 192 | $5.0\times10^7$ | $1.0\times10^3$ | 168 | 4 | 1.9/1.0 |
| 2 | particles | $5.0\times10^2$ | 180 | $5.0\times10^7$ | $1.0\times10^5$ | 188 | 4 | 1.6/1.0 |
| 3 | coated | $5.0\times10^6$ | 207 | $5.0\times10^9$ | $1.0\times10^3$ | 144 | 4 | 2.4/1.0 |
| 4 | with | $5.0\times10^4$ | 195 | $5.0\times10^9$ | $1.0\times10^5$ | 163 | 4 | 2.0/1.0 |

TABLE 1-continued

| Coating liquid for conductive layer | Metal oxide particles (P) Type | Powder resistivity (x) (Ω · cm) | Amt. (pt) | Powder resistivity of core particles (y) (Ω · cm) | y/x | Binder material (B) (phenol resin) Amount (parts) (resin solid content: 60 ms. % of the fol.) | Dispersing time (h) | P/B in coating liquid for conductive layer |
|---|---|---|---|---|---|---|---|---|
| 5 | $SnO_2$ | $1.0 \times 10^5$ | 198 | $1.0 \times 10^8$ | $1.0 \times 10^3$ | 157 | 4 | 2.1/1.0 |
| 6 | doped | $1.0 \times 10^4$ | 192 | $1.0 \times 10^8$ | $1.0 \times 10^4$ | 168 | 4 | 1.9/1.0 |
| 7 | with P | $1.0 \times 10^3$ | 184 | $1.0 \times 10^8$ | $1.0 \times 10^5$ | 181 | 4 | 1.7/1.0 |
| 8 | (av. | $5.0 \times 10^3$ | 184 | $5.0 \times 10^7$ | $1.0 \times 10^4$ | 181 | 4 | 1.7/1.0 |
| 9 | prim. | $5.0 \times 10^5$ | 202 | $5.0 \times 10^9$ | $1.0 \times 10^4$ | 153 | 4 | 2.2/1.0 |
| 10 | particle | $1.0 \times 10^5$ | 198 | $1.0 \times 10^9$ | $1.0 \times 10^4$ | 157 | 4 | 2.1/1.0 |
| 11 | diam.: | $5.0 \times 10^5$ | 198 | $5.0 \times 10^7$ | $1.0 \times 10^2$ | 157 | 4 | 2.1/1.0 |
| 12 | 250 nm) | $5.0 \times 10^1$ | 176 | $5.0 \times 10^7$ | $1.0 \times 10^6$ | 195 | 4 | 1.5/1.0 |
| 13 | | $5.0 \times 10^7$ | 214 | $5.0 \times 10^9$ | $1.0 \times 10^2$ | 132 | 4 | 2.7/1.0 |
| 14 | | $5.0 \times 10^3$ | 188 | $5.0 \times 10^9$ | $1.0 \times 10^6$ | 174 | 4 | 1.8/1.0 |
| 15 | | $1.0 \times 10^6$ | 204 | $1.0 \times 10^8$ | $1.0 \times 10^2$ | 148 | 4 | 2.3/1.0 |
| 16 | | $1.0 \times 10^2$ | 180 | $1.0 \times 10^8$ | $1.0 \times 10^6$ | 188 | 4 | 1.6/1.0 |
| 17 | | $1.0 \times 10^4$ | 207 | $1.0 \times 10^8$ | $1.0 \times 10^4$ | 144 | 4 | 2.4/1.0 |
| 18 | | $1.0 \times 10^4$ | 202 | $1.0 \times 10^8$ | $1.0 \times 10^4$ | 153 | 4 | 2.2/1.0 |
| 19 | | $1.0 \times 10^4$ | 188 | $1.0 \times 10^8$ | $1.0 \times 10^4$ | 174 | 4 | 1.8/1.0 |
| 20 | | $1.0 \times 10^4$ | 184 | $1.0 \times 10^8$ | $1.0 \times 10^4$ | 181 | 4 | 1.7/1.0 |
| 21 | | $1.0 \times 10^4$ | 180 | $1.0 \times 10^8$ | $1.0 \times 10^4$ | 188 | 4 | 1.6/1.0 |
| 22 | | $5.0 \times 10^7$ | 228 | $5.0 \times 10^9$ | $1.0 \times 10^2$ | 109 | 4 | 3.5/1.0 |
| 23 | | $5.0 \times 10^7$ | 223 | $5.0 \times 10^9$ | $1.0 \times 10^2$ | 116 | 4 | 3.2/1.0 |
| 24 | | $5.0 \times 10^7$ | 212 | $5.0 \times 10^9$ | $1.0 \times 10^2$ | 136 | 4 | 2.6/1.0 |
| 25 | | $5.0 \times 10^7$ | 207 | $5.0 \times 10^9$ | $1.0 \times 10^2$ | 144 | 4 | 2.4/1.0 |
| 26 | | $5.0 \times 10^7$ | 202 | $5.0 \times 10^9$ | $1.0 \times 10^2$ | 153 | 4 | 2.2/1.0 |
| 27 | | $1.0 \times 10^4$ | 207 | $1.0 \times 10^8$ | $1.0 \times 10^4$ | 144 | 1.5 | 2.4/1.0 |
| 28 | | $1.0 \times 10^4$ | 207 | $1.0 \times 10^8$ | $1.0 \times 10^4$ | 144 | 6.5 | 2.4/1.0 |
| 29 | $TiO_2$ | $5.0 \times 10^4$ | 192 | $5.0 \times 10^7$ | $1.0 \times 10^3$ | 168 | 4 | 1.9/1.0 |
| 30 | particles | $5.0 \times 10^2$ | 180 | $5.0 \times 10^7$ | $1.0 \times 10^5$ | 188 | 4 | 1.6/1.0 |
| 31 | coated | $5.0 \times 10^6$ | 207 | $5.0 \times 10^9$ | $1.0 \times 10^3$ | 144 | 4 | 2.4/1.0 |
| 32 | with | $5.0 \times 10^4$ | 195 | $5.0 \times 10^9$ | $1.0 \times 10^5$ | 163 | 4 | 2.0/1.0 |
| 33 | $SnO_2$ | $1.0 \times 10^5$ | 198 | $1.0 \times 10^8$ | $1.0 \times 10^3$ | 157 | 4 | 2.1/1.0 |
| 34 | doped | $1.0 \times 10^4$ | 192 | $1.0 \times 10^8$ | $1.0 \times 10^4$ | 168 | 4 | 1.9/1.0 |
| 35 | with W | $1.0 \times 10^3$ | 184 | $1.0 \times 10^8$ | $1.0 \times 10^5$ | 181 | 4 | 1.7/1.0 |
| 36 | (av. | $5.0 \times 10^3$ | 184 | $5.0 \times 10^7$ | $1.0 \times 10^4$ | 181 | 4 | 1.7/1.0 |
| 37 | prim. | $5.0 \times 10^5$ | 202 | $5.0 \times 10^9$ | $1.0 \times 10^4$ | 153 | 4 | 2.2/1.0 |
| 38 | particle | $1.0 \times 10^5$ | 198 | $1.0 \times 10^9$ | $1.0 \times 10^4$ | 157 | 4 | 2.1/1.0 |
| 39 | diam.: | $5.0 \times 10^5$ | 198 | $5.0 \times 10^7$ | $1.0 \times 10^2$ | 157 | 4 | 2.1/1.0 |
| 40 | 250 nm) | $5.0 \times 10^1$ | 176 | $5.0 \times 10^7$ | $1.0 \times 10^6$ | 195 | 4 | 1.5/1.0 |
| 41 | | $5.0 \times 10^7$ | 214 | $5.0 \times 10^9$ | $1.0 \times 10^2$ | 132 | 4 | 2.7/1.0 |
| 42 | | $5.0 \times 10^3$ | 188 | $5.0 \times 10^9$ | $1.0 \times 10^6$ | 174 | 4 | 1.8/1.0 |
| 43 | | $1.0 \times 10^6$ | 204 | $1.0 \times 10^8$ | $1.0 \times 10^2$ | 148 | 4 | 2.3/1.0 |
| 44 | | $1.0 \times 10^2$ | 180 | $1.0 \times 10^8$ | $1.0 \times 10^6$ | 188 | 4 | 1.6/1.0 |
| 45 | | $1.0 \times 10^4$ | 207 | $1.0 \times 10^8$ | $1.0 \times 10^4$ | 144 | 4 | 2.4/1.0 |
| 46 | | $1.0 \times 10^4$ | 202 | $1.0 \times 10^8$ | $1.0 \times 10^4$ | 153 | 4 | 2.2/1.0 |
| 47 | | $1.0 \times 10^4$ | 188 | $1.0 \times 10^8$ | $1.0 \times 10^4$ | 174 | 4 | 1.8/1.0 |
| 48 | | $1.0 \times 10^4$ | 184 | $1.0 \times 10^8$ | $1.0 \times 10^4$ | 181 | 4 | 1.7/1.0 |
| 49 | | $1.0 \times 10^4$ | 180 | $1.0 \times 10^8$ | $1.0 \times 10^4$ | 188 | 4 | 1.6/1.0 |
| 50 | | $5.0 \times 10^7$ | 228 | $5.0 \times 10^9$ | $1.0 \times 10^2$ | 109 | 4 | 3.5/1.0 |
| 51 | | $5.0 \times 10^7$ | 223 | $5.0 \times 10^9$ | $1.0 \times 10^2$ | 116 | 4 | 3.2/1.0 |
| 52 | | $5.0 \times 10^7$ | 212 | $5.0 \times 10^9$ | $1.0 \times 10^2$ | 136 | 4 | 2.6/1.0 |
| 53 | | $5.0 \times 10^7$ | 207 | $5.0 \times 10^9$ | $1.0 \times 10^2$ | 144 | 4 | 2.4/1.0 |
| 54 | | $5.0 \times 10^7$ | 202 | $5.0 \times 10^9$ | $1.0 \times 10^2$ | 153 | 4 | 2.2/1.0 |
| 55 | | $1.0 \times 10^4$ | 207 | $1.0 \times 10^8$ | $1.0 \times 10^4$ | 144 | 1.5 | 2.4/1.0 |
| 56 | | $1.0 \times 10^4$ | 207 | $1.0 \times 10^8$ | $1.0 \times 10^4$ | 144 | 6.5 | 2.4/1.0 |
| 57 | $TiO_2$ | $5.0 \times 10^5$ | 176 | $5.0 \times 10^7$ | $1.0 \times 10^2$ | 195 | 4 | 1.5/1.0 |
| 58 | particles | $5.0 \times 10^5$ | 228 | $5.0 \times 10^7$ | $1.0 \times 10^2$ | 109 | 4 | 3.5/1.0 |
| 59 | coated | $5.0 \times 10^1$ | 228 | $5.0 \times 10^7$ | $1.0 \times 10^6$ | 109 | 4 | 3.5/1.0 |
| 60 | with | $5.0 \times 10^7$ | 176 | $5.0 \times 10^9$ | $1.0 \times 10^2$ | 195 | 4 | 1.5/1.0 |
| 61 | $SnO_2$ | $5.0 \times 10^3$ | 176 | $5.0 \times 10^9$ | $1.0 \times 10^6$ | 195 | 4 | 1.5/1.0 |
| 62 | doped with P (av. prim. particle diam.: 250 nm) | $5.0 \times 10^3$ | 228 | $5.0 \times 10^9$ | $1.0 \times 10^6$ | 109 | 4 | 3.5/1.0 |

TABLE 1-continued

| Coating liquid for conductive layer | Metal oxide particles (P) Type | Powder resistivity (x) (Ω · cm) | Amt. (pt) | Powder resistivity of core particles (y) (Ω · cm) | y/x | Binder material (B) (phenol resin) Amount (parts) (resin solid content: 60 ms. % of the fol.) | Dispersing time (h) | P/B in coating liquid for conductive layer |
|---|---|---|---|---|---|---|---|---|
| 63 | $TiO_2$ | $5.0 \times 10^5$ | 176 | $5.0 \times 10^7$ | $1.0 \times 10^2$ | 195 | 4 | 1.5/1.0 |
| 64 | particle | $5.0 \times 10^5$ | 228 | $5.0 \times 10^7$ | $1.0 \times 10^2$ | 109 | 4 | 3.5/1.0 |
| 65 | coated | $5.0 \times 10^1$ | 228 | $5.0 \times 10^7$ | $1.0 \times 10^6$ | 109 | 4 | 3.5/1.0 |
| 66 | with | $5.0 \times 10^7$ | 176 | $5.0 \times 10^9$ | $1.0 \times 10^2$ | 195 | 4 | 1.5/1.0 |
| 67 | $SnO_2$ | $5.0 \times 10^3$ | 176 | $5.0 \times 10^9$ | $1.0 \times 10^6$ | 195 | 4 | 1.5/1.0 |
| 68 | doped with W (av.) prim. particle diam.: 250 nm) | $5.0 \times 10^3$ | 228 | $5.0 \times 10^9$ | $1.0 \times 10^6$ | 109 | 4 | 3.5/1.0 |

TABLE 2

| Coating liquid for conductive layer | Metal oxide particles (P) Type | Powder resistivity (x) (Ω · cm) | Amt. (pt) | Powder resistivity of core particles (y) (Ω · cm) | y/x | Binder material (B) (phenol resin) Amount (parts) (resin solid content: 60 ms. % of the fol.) | Dispersing time (h) | P/B in coating liquid for conductive layer |
|---|---|---|---|---|---|---|---|---|
| C1 | $TiO_2$ | $1.0 \times 10^6$ | 198 | $5.0 \times 10^7$ | $5.0 \times 10^1$ | 157 | 4 | 2.1/1.0 |
| C2 | particles | $1.0 \times 10^5$ | 195 | $1.0 \times 10^7$ | $1.0 \times 10^2$ | 163 | 4 | 2.0/1.0 |
| C3 | coated | $1.0 \times 10^1$ | 171 | $1.0 \times 10^7$ | $1.0 \times 10^6$ | 204 | 4 | 1.4/1.0 |
| C4 | with | $1.0 \times 10^1$ | 166 | $5.0 \times 10^7$ | $5.0 \times 10^6$ | 212 | 4 | 1.3/1.0 |
| C5 | $SnO_2$ | $1.0 \times 10^3$ | 184 | $5.0 \times 10^9$ | $5.0 \times 10^6$ | 181 | 4 | 1.7/1.0 |
| C6 | doped | $1.0 \times 10^4$ | 192 | $1.0 \times 10^{10}$ | $1.0 \times 10^6$ | 168 | 4 | 1.9/1.0 |
| C7 | with P | $1.0 \times 10^8$ | 216 | $1.0 \times 10^{10}$ | $1.0 \times 10^2$ | 129 | 4 | 2.8/1.0 |
| C8 | (av. | $1.0 \times 10^8$ | 216 | $5.0 \times 10^9$ | $5.0 \times 10^1$ | 129 | 4 | 2.8/1.0 |
| C9 | prim. | $1.0 \times 10^3$ | 184 | $1.0 \times 10^7$ | $1.0 \times 10^4$ | 181 | 4 | 1.7/1.0 |
| C10 | particle | $2.0 \times 10^1$ | 176 | $1.0 \times 10^8$ | $5.0 \times 10^6$ | 195 | 4 | 1.5/1.0 |
| C11 | diam.: | $1.0 \times 10^4$ | 212 | $1.0 \times 10^8$ | $1.0 \times 10^4$ | 136 | 2.5 | 2.6/1.0 |
| C12 | 250 nm) | $1.0 \times 10^4$ | 176 | $1.0 \times 10^8$ | $1.0 \times 10^4$ | 195 | 6 | 1.5/1.0 |
| C13 | | $5.0 \times 10^7$ | 229 | $5.0 \times 10^9$ | $1.0 \times 10^2$ | 106 | 4 | 3.6/1.0 |
| C14 | | $5.0 \times 10^7$ | 198 | $5.0 \times 10^9$ | $1.0 \times 10^2$ | 157 | 6 | 2.1/1.0 |
| C15 | | $5.0 \times 10^7$ | 229 | $5.0 \times 10^9$ | $1.0 \times 10^2$ | 106 | 2.5 | 3.6/1.0 |
| C16 | | $1.0 \times 10^4$ | 171 | $1.0 \times 10^8$ | $1.0 \times 10^4$ | 204 | 6 | 1.4/1.0 |
| C17 | $TiO_2$ | $1.0 \times 10^6$ | 198 | $5.0 \times 10^7$ | $5.0 \times 10^1$ | 157 | 4 | 2.1/1.0 |
| C18 | particles | $1.0 \times 10^5$ | 195 | $1.0 \times 10^7$ | $1.0 \times 10^2$ | 163 | 4 | 2.0/1.0 |
| C19 | coated | $1.0 \times 10^1$ | 171 | $1.0 \times 10^7$ | $1.0 \times 10^6$ | 204 | 4 | 1.4/1.0 |
| C20 | with | $1.0 \times 10^1$ | 166 | $5.0 \times 10^7$ | $5.0 \times 10^6$ | 212 | 4 | 1.3/1.0 |
| C21 | $SnO_2$ | $1.0 \times 10^3$ | 184 | $5.0 \times 10^9$ | $5.0 \times 10^6$ | 181 | 4 | 1.7/1.0 |
| C22 | doped | $1.0 \times 10^4$ | 192 | $1.0 \times 10^{10}$ | $1.0 \times 10^6$ | 168 | 4 | 1.9/1.0 |
| C23 | with W | $1.0 \times 10^8$ | 216 | $1.0 \times 10^{10}$ | $1.0 \times 10^2$ | 129 | 4 | 2.8/1.0 |
| C24 | (av. | $1.0 \times 10^8$ | 216 | $5.0 \times 10^9$ | $5.0 \times 10^1$ | 129 | 4 | 2.8/1.0 |
| C25 | prim. | $1.0 \times 10^3$ | 184 | $1.0 \times 10^7$ | $1.0 \times 10^4$ | 181 | 4 | 1.7/1.0 |
| C26 | particle | $2.0 \times 10^1$ | 176 | $1.0 \times 10^8$ | $5.0 \times 10^6$ | 195 | 4 | 1.5/1.0 |
| C27 | diam.: | $1.0 \times 10^4$ | 212 | $1.0 \times 10^8$ | $1.0 \times 10^4$ | 136 | 2.5 | 2.6/1.0 |
| C28 | 250 nm) | $1.0 \times 10^4$ | 176 | $1.0 \times 10^8$ | $1.0 \times 10^4$ | 195 | 6 | 1.5/1.0 |
| C29 | | $5.0 \times 10^7$ | 229 | $5.0 \times 10^9$ | $1.0 \times 10^2$ | 106 | 4 | 3.6/1.0 |
| C30 | | $5.0 \times 10^7$ | 198 | $5.0 \times 10^9$ | $1.0 \times 10^2$ | 157 | 6 | 2.1/1.0 |
| C31 | | $5.0 \times 10^7$ | 229 | $5.0 \times 10^9$ | $1.0 \times 10^2$ | 106 | 2.5 | 3.6/1.0 |
| C32 | | $1.0 \times 10^4$ | 171 | $1.0 \times 10^8$ | $1.0 \times 10^4$ | 204 | 6 | 1.4/1.0 |

TABLE 2-continued

| Coating liquid for conductive layer | Metal oxide particles (P) Type | Powder resistivity (x) (Ω · cm) | Amt. (pt) | Powder resistivity of core particles (y) (Ω · cm) | y/x | Binder material (B) (phenol resin) Amount (parts) (resin solid content: 60 ms. % of the fol.) | Dispersing time (h) | P/B in coating liquid for conductive layer |
|---|---|---|---|---|---|---|---|---|
| C33 | $TiO_2$ particles coated with oxygen deficient $SnO_2$ (av. prim. particle diam.: 250 nm) | $1.0 \times 10^4$ | 192 | $1.0 \times 10^8$ | $1.0 \times 10^4$ | 168 | 4 | 1.9/1.0 |
| C34 | | $5.0 \times 10^7$ | 214 | $5.0 \times 10^9$ | $1.0 \times 10^2$ | 132 | 4 | 2.7/1.0 |
| C35 | $TiO_2$ particles coated with $SnO_2$ doped with Sb (av. prim. particle diam.: 250 nm) | $1.0 \times 10^2$ | 176 | $1.0 \times 10^8$ | $1.0 \times 10^6$ | 195 | 4 | 1.5/1.0 |
| C36 | $TiO_2$ particles coated with undoped $SnO_2$ (av. prim. particle diam.: 250 nm) | $1.0 \times 10^5$ | 220 | $1.0 \times 10^8$ | $1.0 \times 10^3$ | 122 | 4 | 3.0/1.0 |
| C37 | $BaSO_4$ particles coated with $SnO_2$ doped with P (av. prim. particle diam.: 220 nm) | $1.0 \times 10^4$ | 198 | $1.0 \times 10^8$ | $1.0 \times 10^4$ | 157 | 4 | 2.1/1.0 |
| C38 | $TiO_2$ particles coated with $SnO_2$ doped with P (av. prim. particle diam.: 250 nm) | $5.0 \times 10^5$ | 171 | $5.0 \times 10^7$ | $1.0 \times 10^2$ | 204 | 4 | 1.4/1.0 |
| C39 | | $5.0 \times 10^5$ | 229 | $5.0 \times 10^7$ | $1.0 \times 10^2$ | 106 | 4 | 3.6/1.0 |
| C40 | | $5.0 \times 10^1$ | 171 | $5.0 \times 10^7$ | $1.0 \times 10^6$ | 204 | 4 | 1.4/1.0 |
| C41 | | $5.0 \times 10^1$ | 229 | $5.0 \times 10^7$ | $1.0 \times 10^6$ | 106 | 4 | 3.6/1.0 |
| C42 | | $1.0 \times 10^6$ | 176 | $5.0 \times 10^7$ | $5.0 \times 10^1$ | 195 | 4 | 1.5/1.0 |
| C43 | | $1.0 \times 10^1$ | 176 | $5.0 \times 10^7$ | $5.0 \times 10^6$ | 195 | 4 | 1.5/1.0 |
| C44 | | $1.0 \times 10^6$ | 228 | $5.0 \times 10^7$ | $5.0 \times 10^1$ | 109 | 4 | 3.5/1.0 |
| C45 | | $1.0 \times 10^1$ | 228 | $5.0 \times 10^7$ | $5.0 \times 10^6$ | 109 | 4 | 3.5/1.0 |
| C46 | | $5.0 \times 10^7$ | 171 | $5.0 \times 10^9$ | $1.0 \times 10^2$ | 204 | 4 | 1.4/1.0 |
| C47 | | $5.0 \times 10^3$ | 171 | $5.0 \times 10^9$ | $1.0 \times 10^6$ | 204 | 4 | 1.4/1.0 |
| C48 | | $5.0 \times 10^3$ | 229 | $5.0 \times 10^9$ | $1.0 \times 10^6$ | 106 | 4 | 3.6/1.0 |
| C49 | | $1.0 \times 10^8$ | 176 | $5.0 \times 10^9$ | $5.0 \times 10^1$ | 195 | 4 | 1.5/1.0 |
| C50 | | $1.0 \times 10^3$ | 176 | $5.0 \times 10^9$ | $5.0 \times 10^6$ | 195 | 4 | 1.5/1.0 |
| C51 | | $1.0 \times 10^8$ | 228 | $5.0 \times 10^9$ | $5.0 \times 10^1$ | 109 | 4 | 3.5/1.0 |
| C52 | | $1.0 \times 10^3$ | 228 | $5.0 \times 10^9$ | $5.0 \times 10^6$ | 109 | 4 | 3.5/1.0 |
| C53 | | $1.0 \times 10^5$ | 176 | $1.0 \times 10^7$ | $1.0 \times 10^2$ | 195 | 4 | 1.5/1.0 |
| C54 | | $1.0 \times 10^8$ | 176 | $1.0 \times 10^{10}$ | $1.0 \times 10^2$ | 195 | 4 | 1.5/1.0 |

TABLE 2-continued

| Coating liquid for conductive layer | Metal oxide particles (P) Type | Powder resistivity (x) (Ω · cm) | Amt. (pt) | Powder resistivity of core particles (y) (Ω · cm) | y/x | Binder material (B) (phenol resin) Amount (parts) (resin solid content: 60 ms. % of the fol.) | Dispersing time (h) | P/B in coating liquid for conductive layer |
|---|---|---|---|---|---|---|---|---|
| C55 | | $1.0 \times 10^5$ | 228 | $1.0 \times 10^7$ | $1.0 \times 10^2$ | 109 | 4 | 3.5/1.0 |
| C56 | | $1.0 \times 10^8$ | 228 | $1.0 \times 10^{10}$ | $1.0 \times 10^2$ | 109 | 4 | 3.5/1.0 |
| C57 | | $1.0 \times 10^1$ | 176 | $1.0 \times 10^7$ | $1.0 \times 10^6$ | 195 | 4 | 1.5/1.0 |
| C58 | | $1.0 \times 10^4$ | 176 | $1.0 \times 10^{10}$ | $1.0 \times 10^6$ | 195 | 4 | 1.5/1.0 |
| C59 | | $1.0 \times 10^1$ | 228 | $1.0 \times 10^7$ | $1.0 \times 10^6$ | 109 | 4 | 3.5/1.0 |
| C60 | | $1.0 \times 10^4$ | 228 | $1.0 \times 10^{10}$ | $1.0 \times 10^6$ | 109 | 4 | 3.5/1.0 |
| C61 | $TiO_2$ | $5.0 \times 10^5$ | 171 | $5.0 \times 10^7$ | $1.0 \times 10^2$ | 204 | 4 | 1.4/1.0 |
| C62 | particles | $5.0 \times 10^5$ | 229 | $5.0 \times 10^7$ | $1.0 \times 10^2$ | 106 | 4 | 3.6/1.0 |
| C63 | coated | $5.0 \times 10^1$ | 171 | $5.0 \times 10^7$ | $1.0 \times 10^6$ | 204 | 4 | 1.4/1.0 |
| C64 | with | $5.0 \times 10^1$ | 229 | $5.0 \times 10^7$ | $1.0 \times 10^6$ | 106 | 4 | 3.6/1.0 |
| C65 | $SnO_2$ | $1.0 \times 10^6$ | 176 | $5.0 \times 10^7$ | $5.0 \times 10^1$ | 195 | 4 | 1.5/1.0 |
| C66 | doped | $1.0 \times 10^1$ | 176 | $5.0 \times 10^7$ | $5.0 \times 10^6$ | 195 | 4 | 1.5/1.0 |
| C67 | with W | $1.0 \times 10^6$ | 228 | $5.0 \times 10^7$ | $5.0 \times 10^1$ | 109 | 4 | 3.5/1.0 |
| C68 | (av. | $1.0 \times 10^1$ | 228 | $5.0 \times 10^7$ | $5.0 \times 10^6$ | 109 | 4 | 3.5/1.0 |
| C69 | prim. | $5.0 \times 10^7$ | 171 | $5.0 \times 10^9$ | $1.0 \times 10^2$ | 204 | 4 | 1.4/1.0 |
| C70 | particle | $5.0 \times 10^3$ | 171 | $5.0 \times 10^9$ | $1.0 \times 10^6$ | 204 | 4 | 1.4/1.0 |
| C71 | diam.: | $5.0 \times 10^3$ | 229 | $5.0 \times 10^9$ | $1.0 \times 10^6$ | 106 | 4 | 3.6/1.0 |
| C72 | 250 nm) | $1.0 \times 10^8$ | 176 | $5.0 \times 10^9$ | $5.0 \times 10^1$ | 195 | 4 | 1.5/1.0 |
| C73 | | $1.0 \times 10^3$ | 176 | $5.0 \times 10^9$ | $5.0 \times 10^6$ | 195 | 4 | 1.5/1.0 |
| C74 | | $1.0 \times 10^8$ | 228 | $5.0 \times 10^9$ | $5.0 \times 10^1$ | 109 | 4 | 3.5/1.0 |
| C75 | | $1.0 \times 10^3$ | 228 | $5.0 \times 10^9$ | $5.0 \times 10^6$ | 109 | 4 | 3.5/1.0 |
| C76 | | $1.0 \times 10^5$ | 176 | $1.0 \times 10^7$ | $1.0 \times 10^2$ | 195 | 4 | 1.5/1.0 |
| C77 | | $1.0 \times 10^8$ | 176 | $1.0 \times 10^{10}$ | $1.0 \times 10^2$ | 195 | 4 | 1.5/1.0 |
| C78 | | $1.0 \times 10^5$ | 228 | $1.0 \times 10^7$ | $1.0 \times 10^2$ | 109 | 4 | 3.5/1.0 |
| C79 | | $1.0 \times 10^8$ | 228 | $1.0 \times 10^{10}$ | $1.0 \times 10^2$ | 109 | 4 | 3.5/1.0 |
| C80 | | $1.0 \times 10^1$ | 176 | $1.0 \times 10^7$ | $1.0 \times 10^6$ | 195 | 4 | 1.5/1.0 |
| C81 | | $1.0 \times 10^4$ | 176 | $1.0 \times 10^{10}$ | $1.0 \times 10^6$ | 195 | 4 | 1.5/1.0 |
| C82 | | $1.0 \times 10^1$ | 228 | $1.0 \times 10^7$ | $1.0 \times 10^6$ | 109 | 4 | 3.5/1.0 |
| C83 | | $1.0 \times 10^4$ | 228 | $1.0 \times 10^{10}$ | $1.0 \times 10^6$ | 109 | 4 | 3.5/1.0 |

Electrophotographic Photosensitive Member Production Examples

Production Example of Electrophotographic Photosensitive Member 1

An aluminum cylinder (JIS A3003, aluminum alloy) of 246 mm in length and 24 mm in diameter which was produced by a production process having the step of extrusion and the step of drawing was used as a support.

The coating liquid 1 for conductive layer was dip-coated on the support in a normal-temperature and normal-humidity (23° C./50% RH) environment, and then the wet coating formed was dried and heat-cured at 140° C. for 30 minutes to form a conductive layer with a layer thickness of 30 μm. The volume resistivity of the conductive layer was measured by the method described previously, to find that it was $5.0 \times 10^{10}$ Ω·cm.

Next, 4.5 parts of N-methoxymethylated nylon (trade name: TORESIN EF-30T; available from Nagase ChemteX Corporation) and 1.5 parts of copolymer nylon resin (trade name: AMILAN CM8000; available from Toray Industries, Inc.) were dissolved in a mixed solvent of 65 parts of methanol and 30 parts of n-butanol to prepare a coating liquid for undercoat layer. This coating liquid for undercoat layer obtained was dip-coated on the conductive layer, and then the wet coating formed was dried at 70° C. for 6 minutes to form an undercoat layer with a layer thickness of 0.85 μm.

Next, 10 parts of hydroxygallium phthalocyanine crystals (charge-generating material) with a crystal form having intense peaks at 7.5°, 9.9°, 16.3°, 18.6°, 25.1° and 28.3° of the Bragg's angle 2θ±0.2° in CuKα characteristic X-ray diffraction, 5 parts of polyvinyl butyral resin (trade name: S-LEC BX-1; available from Sekisui Chemical Co., Ltd.) and 250 parts of cyclohexanone were put into a sand mill making use of glass beads of 0.8 mm in diameter, and put to dispersion treatment under conditions of a dispersion treatment time of 3 hours. Next, to the resultant system, 250 parts of ethyl acetate was added to prepare a coating liquid for charge generation layer. This coating liquid for charge generation layer was dip-coated on the undercoat layer, and then the wet coating formed was dried at 100° C. for 10 minutes to form a charge generation layer with a layer thickness of 0.12 μm.

Next, 4.0 parts of an amine compound (charge-transporting material) represented by the following formula (CT-1), 4.0 parts of an amine compound represented by the following formula (CT-2):

(CT-1)

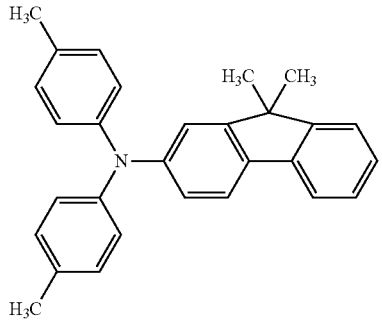

-continued (CT-2)

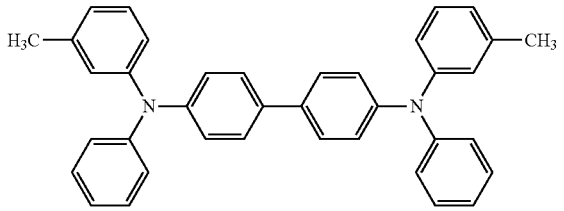

and 10 parts of polycarbonate (trade name: Z200; available from Mitsubishi Engineering-Plastics Corporation) were dissolved in a mixed solvent of 30 parts of dimethoxymethane and 70 parts of chlorobenzene to prepare a coating liquid for charge transport layer. This coating liquid for charge transport layer was dip-coated on the charge generation layer, and then the wet coating formed was dried at 110° C. for 30 minutes to form a charge transport layer with a layer thickness of 7.0 μm.

Thus, an electrophotographic photosensitive member 1 was produced the charge transport layer of which was a surface layer.

Production Examples of Electrophotographic Photosensitive Members 2 to 68 & C1 to C83

Electrophotographic photosensitive members 2 to 68 and C1 to C83 were produced in the same manner as Production Example of Electrophotographic Photosensitive Member 1 except that the coating liquid for conductive layer, the coating liquid 1 for conductive layer, used in producing the electrophotographic photosensitive member was changed for the coating liquids 2 to 68 and C1 to C83 for conductive layer, respectively. Here, in regard to the volume resistivity of the electrophotographic photosensitive members 2 to 68 and C1 to C83 each, too, it was measured like the electrophotographic photosensitive member 1 by the method described previously. Results obtained thereon are shown in Tables 3 and 4.

TABLE 3

| Electrophotographic photosensitive member | Coating liquid for conductive layer | Volume resistivity of conductive layer (Ω · cm) |
|---|---|---|
| 1 | 1 | $5.0 \times 10^{10}$ |
| 2 | 2 | $5.0 \times 10^{10}$ |
| 3 | 3 | $5.0 \times 10^{10}$ |
| 4 | 4 | $5.0 \times 10^{10}$ |
| 5 | 5 | $5.0 \times 10^{10}$ |
| 6 | 6 | $5.0 \times 10^{10}$ |
| 7 | 7 | $5.0 \times 10^{10}$ |
| 8 | 8 | $5.0 \times 10^{10}$ |
| 9 | 9 | $5.0 \times 10^{10}$ |
| 10 | 10 | $5.0 \times 10^{10}$ |
| 11 | 11 | $5.0 \times 10^{10}$ |
| 12 | 12 | $5.0 \times 10^{10}$ |
| 13 | 13 | $5.0 \times 10^{10}$ |
| 14 | 14 | $5.0 \times 10^{10}$ |
| 15 | 15 | $5.0 \times 10^{10}$ |
| 16 | 16 | $5.0 \times 10^{10}$ |
| 17 | 17 | $3.0 \times 10^{10}$ |
| 18 | 18 | $4.0 \times 10^{10}$ |
| 19 | 19 | $5.5 \times 10^{10}$ |
| 20 | 20 | $6.0 \times 10^{10}$ |
| 21 | 21 | $7.0 \times 10^{10}$ |
| 22 | 22 | $3.0 \times 10^{10}$ |
| 23 | 23 | $4.0 \times 10^{10}$ |
| 24 | 24 | $5.5 \times 10^{10}$ |
| 25 | 25 | $6.0 \times 10^{10}$ |

TABLE 3-continued

| Electrophotographic photosensitive member | Coating liquid for conductive layer | Volume resistivity of conductive layer (Ω · cm) |
|---|---|---|
| 26 | 26 | $7.0 \times 10^{10}$ |
| 27 | 27 | $1.0 \times 10^{8}$ |
| 28 | 28 | $5.0 \times 10^{12}$ |
| 29 | 29 | $5.0 \times 10^{10}$ |
| 30 | 30 | $5.0 \times 10^{10}$ |
| 31 | 31 | $5.0 \times 10^{10}$ |
| 32 | 32 | $5.0 \times 10^{10}$ |
| 33 | 33 | $5.0 \times 10^{10}$ |
| 34 | 34 | $5.0 \times 10^{10}$ |
| 35 | 35 | $5.0 \times 10^{10}$ |
| 36 | 36 | $5.0 \times 10^{10}$ |
| 37 | 37 | $5.0 \times 10^{10}$ |
| 38 | 38 | $5.0 \times 10^{10}$ |
| 39 | 39 | $5.0 \times 10^{10}$ |
| 40 | 40 | $5.0 \times 10^{10}$ |
| 41 | 41 | $5.0 \times 10^{10}$ |
| 42 | 42 | $5.0 \times 10^{10}$ |
| 43 | 43 | $5.0 \times 10^{10}$ |
| 44 | 44 | $5.0 \times 10^{10}$ |
| 45 | 45 | $3.0 \times 10^{10}$ |
| 46 | 46 | $4.0 \times 10^{10}$ |
| 47 | 47 | $5.5 \times 10^{10}$ |
| 48 | 48 | $6.0 \times 10^{10}$ |
| 49 | 49 | $7.0 \times 10^{10}$ |
| 50 | 50 | $3.0 \times 10^{10}$ |
| 51 | 51 | $4.0 \times 10^{10}$ |
| 52 | 52 | $5.5 \times 10^{10}$ |
| 53 | 53 | $6.0 \times 10^{10}$ |
| 54 | 54 | $7.0 \times 10^{10}$ |
| 55 | 55 | $1.0 \times 10^{8}$ |
| 56 | 56 | $5.0 \times 10^{12}$ |
| 57 | 57 | $1.0 \times 10^{12}$ |
| 58 | 58 | $8.0 \times 10^{9}$ |
| 59 | 59 | $1.0 \times 10^{8}$ |
| 60 | 60 | $5.0 \times 10^{12}$ |
| 61 | 61 | $3.0 \times 10^{11}$ |
| 62 | 62 | $2.0 \times 10^{9}$ |
| 63 | 63 | $1.0 \times 10^{12}$ |
| 64 | 64 | $8.0 \times 10^{9}$ |
| 65 | 65 | $1.0 \times 10^{8}$ |
| 66 | 66 | $5.0 \times 10^{12}$ |
| 67 | 67 | $3.0 \times 10^{11}$ |
| 68 | 68 | $2.0 \times 10^{9}$ |

TABLE 4

| Electrophotographic photosensitive member | Coating liquid for conductive layer | Volume resistivity of conductive layer (Ω · cm) |
|---|---|---|
| C1 | C1 | $5.0 \times 10^{10}$ |
| C2 | C2 | $5.0 \times 10^{10}$ |
| C3 | C3 | $5.0 \times 10^{10}$ |
| C4 | C4 | $5.0 \times 10^{10}$ |
| C5 | C5 | $5.0 \times 10^{10}$ |
| C6 | C6 | $5.0 \times 10^{10}$ |
| C7 | C7 | $5.0 \times 10^{10}$ |
| C8 | C8 | $5.0 \times 10^{10}$ |
| C9 | C9 | $5.0 \times 10^{10}$ |
| C10 | C10 | $6.0 \times 10^{10}$ |
| C11 | C11 | $5.0 \times 10^{7}$ |
| C12 | C12 | $1.0 \times 10^{13}$ |
| C13 | C13 | $1.0 \times 10^{10}$ |
| C14 | C14 | $1.0 \times 10^{13}$ |
| C15 | C15 | $1.0 \times 10^{8}$ |
| C16 | C16 | $5.0 \times 10^{12}$ |
| C17 | C17 | $5.0 \times 10^{10}$ |
| C18 | C18 | $5.0 \times 10^{10}$ |
| C19 | C19 | $5.0 \times 10^{10}$ |
| C20 | C20 | $5.0 \times 10^{10}$ |
| C21 | C21 | $5.0 \times 10^{10}$ |
| C22 | C22 | $5.0 \times 10^{10}$ |
| C23 | C23 | $5.0 \times 10^{10}$ |

TABLE 4-continued

| Electrophotographic photosensitive member | Coating liquid for conductive layer | Volume resistivity of conductive layer (Ω · cm) |
|---|---|---|
| C24 | C24 | $5.0 \times 10^{10}$ |
| C25 | C25 | $5.0 \times 10^{10}$ |
| C26 | C26 | $6.0 \times 10^{10}$ |
| C27 | C27 | $5.0 \times 10^{7}$ |
| C28 | C28 | $1.0 \times 10^{13}$ |
| C29 | C29 | $1.0 \times 10^{10}$ |
| C30 | C30 | $1.0 \times 10^{13}$ |
| C31 | C31 | $1.0 \times 10^{8}$ |
| C32 | C32 | $5.0 \times 10^{12}$ |
| C33 | C33 | $5.0 \times 10^{10}$ |
| C34 | C34 | $5.0 \times 10^{10}$ |
| C35 | C35 | $5.0 \times 10^{10}$ |
| C36 | C36 | $5.0 \times 10^{10}$ |
| C37 | C37 | $5.0 \times 10^{10}$ |
| C38 | C38 | $3.0 \times 10^{12}$ |
| C39 | C39 | $5.0 \times 10^{9}$ |
| C40 | C40 | $7.0 \times 10^{10}$ |
| C41 | C41 | $7.0 \times 10^{7}$ |
| C42 | C42 | $2.0 \times 10^{12}$ |
| C43 | C43 | $1.0 \times 10^{10}$ |
| C44 | C44 | $1.0 \times 10^{10}$ |
| C45 | C45 | $1.0 \times 10^{7}$ |
| C46 | C46 | $7.0 \times 10^{12}$ |
| C47 | C47 | $5.0 \times 10^{11}$ |
| C48 | C48 | $1.0 \times 10^{9}$ |
| C49 | C49 | $7.0 \times 10^{12}$ |
| C50 | C50 | $1.0 \times 10^{11}$ |
| C51 | C51 | $4.0 \times 10^{10}$ |
| C52 | C52 | $1.0 \times 10^{9}$ |
| C53 | C53 | $8.0 \times 10^{11}$ |
| C54 | C54 | $7.0 \times 10^{12}$ |
| C55 | C55 | $5.0 \times 10^{9}$ |
| C56 | C56 | $4.0 \times 10^{10}$ |
| C57 | C57 | $3.0 \times 10^{10}$ |
| C58 | C58 | $5.0 \times 10^{11}$ |
| C59 | C59 | $5.0 \times 10^{7}$ |
| C60 | C60 | $3.0 \times 10^{9}$ |
| C61 | C61 | $3.0 \times 10^{12}$ |
| C62 | C62 | $5.0 \times 10^{9}$ |
| C63 | C63 | $7.0 \times 10^{10}$ |
| C64 | C64 | $7.0 \times 10^{7}$ |
| C65 | C65 | $2.0 \times 10^{12}$ |
| C66 | C66 | $1.0 \times 10^{10}$ |
| C67 | C67 | $1.0 \times 10^{10}$ |
| C68 | C68 | $1.0 \times 10^{7}$ |
| C69 | C69 | $7.0 \times 10^{12}$ |
| C70 | C70 | $5.0 \times 10^{11}$ |
| C71 | C71 | $1.0 \times 10^{9}$ |
| C72 | C72 | $7.0 \times 10^{12}$ |
| C73 | C73 | $1.0 \times 10^{11}$ |
| C74 | C74 | $4.0 \times 10^{10}$ |
| C75 | C75 | $1.0 \times 10^{9}$ |
| C76 | C76 | $8.0 \times 10^{11}$ |
| C77 | C77 | $7.0 \times 10^{12}$ |
| C78 | C78 | $5.0 \times 10^{9}$ |
| C79 | C79 | $4.0 \times 10^{10}$ |
| C80 | C80 | $3.0 \times 10^{10}$ |
| C81 | C81 | $5.0 \times 10^{11}$ |
| C82 | C82 | $5.0 \times 10^{7}$ |
| C83 | C83 | $3.0 \times 10^{9}$ |

Incidentally, when the volume resistivity of the conductive layer was measured on the electrophotographic photosensitive members 1 to 68 and C1 to C83 each, the surfaces of their conductive layers were observed on an optical microscope, whereupon cracks were seen to have occurred in regard to the conductive layers of the electrophotographic photosensitive members C13, C15, C29, C31, C39, C41, C48, C62, C64 and C71.

Examples 1 to 68 & Comparative Examples 1 to 83

The electrophotographic photosensitive members 1 to 68 and C1 to C83 were each set in a laser beam printer (trade name: HP LASERJET P1505) manufactured by Hewlett-Packard Co., and the dark attenuation was measured in the following way in a high-temperature and high-humidity (30° C./80% RH) environment.

First, using a potential jig having a potential-measuring probe, charge potential (dark area potential) was measured while solid white images were reproduced on three sheets. On that occasion, during the reproduction of images on three sheets, a power source of the potential-measuring probe was kept ON, in the state of which a power source of the laser beam printer was forcedly switched OFF. Charge potential $Vd_1$ immediately before the latter power source was switched OFF and charge potential $Vd_2$ on lapse of one second after the latter power source was switched OFF were each measured to find the value of dark attenuation rate: $(Vd_2-Vd_2)\times100/Vd_1$ (%). Here, it shows that, the smaller this dark attenuation rate is, the smaller the dark attenuation is. Also, this dark attenuation is herein "dark attenuation before sheet feeding durability test".

Next, the electrophotographic photosensitive members 1 to 68 and C1 to C83 were each put to a sheet feeding durability test in the same high-temperature and high-humidity environment as the above. In the sheet feeding durability test, printing was operated in an intermittent mode in which a character image with a print percentage of 2% was sheet by sheet reproduced on letter size sheet, to reproduce images on 500 sheets.

After the image reproduction on 500 sheets was finished, each electrophotographic photosensitive member was left to stand for 10 minutes, and thereafter the dark attenuation was again measured in the same way as the dark attenuation before sheet feeding durability test to likewise find the dark attenuation rate. The results are shown in Tables 5 and 6.

In addition to the electrophotographic photosensitive members 1 to 68 and C1 to C83 on which the sheet feeding durability test was conducted, one more each of the electrophotographic photosensitive members 2 to 68 and C1 to C83 was readied, and each of them was set in a laser beam printer (trade name: HP LASERJET P1505) manufactured by Hewlett-Packard Co., where the sheet feeding durability test was conducted in a low-temperature and low-humidity (15° C./10% RH) environment. In this sheet feeding durability test, printing was operated in an intermittent mode in which a character image with a print percentage of 2% was sheet by sheet reproduced on letter size sheet, to reproduce images on 3,000 sheets, and any potential variations were measured.

At the start of the sheet feeding durability test and after the finish of the image reproduction on 3,000 sheets, charge potential (dark area potential) and potential at the time of exposure (light area potential) were measured. Each potential was measured using one sheet each of solid white images and solid black images.

The dark area potential at the initial stage (at the start of the sheet feeding durability test) and the light area potential at the initial stage (at the start of the sheet feeding durability test) were represented by Vd and Vl, respectively. The dark area potential after the finish of the image reproduction on 3,000 sheets and the light area potential after the finish of the image reproduction on 3,000 sheets were represented by Vd' and Vl', respectively.

Then, the value of dark area potential variation level ΔVd that is the difference between the dark area potential Vd' after the finish of the image reproduction on 3,000 sheets and the dark area potential Vd at the initial stage, ΔVd (=|Vd'|−|Vd|), and the value of light area potential variation level ΔVl that is the difference between the light area potential Vl' after the finish of the image reproduction on 3,000 sheets and the light area potential Vl at the initial stage, ΔVl (=|Vl'|−|Vl|), were each found. The results are shown in Tables 5 and 6.

TABLE 5

| Example | Electrophotographic photosensitive member | Cracks in conductive layer | Dark attenuation rate (%) Before running test | Dark attenuation rate (%) After finish of 500-sheet image reprod. | Potential variation level (V) ΔVd | Potential variation level (V) ΔVl |
|---|---|---|---|---|---|---|
| 1 | 1 | No | 2.5 | 5.5 | +12 | +25 |
| 2 | 2 | No | 2.6 | 5.6 | +12 | +24 |
| 3 | 3 | No | 2.0 | 5.0 | +13 | +28 |
| 4 | 4 | No | 2.4 | 5.4 | +13 | +27 |
| 5 | 5 | No | 2.4 | 5.4 | +13 | +27 |
| 6 | 6 | No | 2.5 | 5.5 | +12 | +25 |
| 7 | 7 | No | 2.6 | 5.6 | +12 | +24 |
| 8 | 8 | No | 2.6 | 5.6 | +12 | +24 |
| 9 | 9 | No | 2.2 | 5.2 | +13 | +28 |
| 10 | 10 | No | 2.4 | 5.4 | +13 | +27 |
| 11 | 11 | No | 2.4 | 5.4 | +13 | +27 |
| 12 | 12 | No | 3.8 | 7.8 | +12 | +23 |
| 13 | 13 | No | 2.0 | 5.0 | +13 | +30 |
| 14 | 14 | No | 3.0 | 7.0 | +13 | +27 |
| 15 | 15 | No | 2.2 | 5.2 | +13 | +28 |
| 16 | 16 | No | 3.4 | 7.4 | +12 | +24 |
| 17 | 17 | No | 2.9 | 5.9 | +12 | +23 |
| 18 | 18 | No | 2.7 | 5.7 | +12 | +24 |
| 19 | 19 | No | 2.4 | 5.4 | +13 | +25 |
| 20 | 20 | No | 2.2 | 5.2 | +13 | +28 |
| 21 | 21 | No | 2.0 | 5.0 | +14 | +29 |
| 22 | 22 | No | 2.7 | 5.7 | +12 | +27 |
| 23 | 23 | No | 2.4 | 5.4 | +12 | +28 |
| 24 | 24 | No | 2.0 | 5.0 | +13 | +30 |
| 25 | 25 | No | 1.9 | 4.9 | +13 | +32 |
| 26 | 26 | No | 1.9 | 4.9 | +14 | +33 |
| 27 | 27 | No | 3.8 | 7.9 | +12 | +21 |
| 28 | 28 | No | 2.2 | 5.3 | +13 | +30 |
| 29 | 29 | No | 2.8 | 6.3 | +13 | +28 |
| 30 | 30 | No | 2.9 | 6.4 | +13 | +27 |
| 31 | 31 | No | 2.3 | 5.8 | +14 | +31 |
| 32 | 32 | No | 2.7 | 6.2 | +14 | +30 |
| 33 | 33 | No | 2.7 | 6.2 | +14 | +30 |
| 34 | 34 | No | 2.8 | 6.3 | +13 | +28 |
| 35 | 35 | No | 2.9 | 6.4 | +13 | +27 |
| 36 | 36 | No | 2.9 | 6.4 | +13 | +27 |
| 37 | 37 | No | 2.5 | 6.0 | +14 | +31 |
| 38 | 38 | No | 2.7 | 6.2 | +14 | +30 |
| 39 | 39 | No | 2.7 | 6.2 | +14 | +30 |
| 40 | 40 | No | 4.1 | 8.6 | +13 | +26 |
| 41 | 41 | No | 2.3 | 5.8 | +14 | +33 |
| 42 | 42 | No | 3.3 | 7.8 | +14 | +30 |
| 43 | 43 | No | 2.5 | 6.0 | +14 | +31 |
| 44 | 44 | No | 3.7 | 8.2 | +13 | +27 |
| 45 | 45 | No | 3.2 | 6.7 | +13 | +26 |
| 46 | 46 | No | 3.0 | 6.5 | +13 | +27 |
| 47 | 47 | No | 2.7 | 6.2 | +14 | +28 |
| 48 | 48 | No | 2.5 | 6.0 | +14 | +31 |
| 49 | 49 | No | 2.3 | 5.8 | +15 | +32 |
| 50 | 50 | No | 3.0 | 6.5 | +13 | +30 |
| 51 | 51 | No | 2.7 | 6.2 | +13 | +31 |
| 52 | 52 | No | 2.3 | 5.8 | +14 | +33 |
| 53 | 53 | No | 2.2 | 5.7 | +14 | +35 |
| 54 | 54 | No | 2.2 | 5.7 | +15 | +36 |
| 55 | 55 | No | 4.1 | 8.7 | +13 | +24 |
| 56 | 56 | No | 2.5 | 6.1 | +14 | +33 |
| 57 | 57 | No | 2.0 | 5.0 | +13 | +30 |
| 58 | 58 | No | 3.5 | 7.2 | +13 | +25 |
| 59 | 59 | No | 4.8 | 8.8 | +11 | +20 |
| 60 | 60 | No | 1.8 | 4.8 | +14 | +35 |
| 61 | 61 | No | 2.9 | 6.2 | +13 | +28 |
| 62 | 62 | No | 3.9 | 7.2 | +11 | +23 |
| 63 | 63 | No | 2.3 | 5.8 | +14 | +33 |
| 64 | 64 | No | 3.8 | 8.0 | +14 | +28 |
| 65 | 65 | No | 5.1 | 9.6 | +12 | +23 |
| 66 | 66 | No | 2.1 | 5.6 | +15 | +38 |

TABLE 5-continued

| Example | Electrophotographic photosensitive member | Cracks in conductive layer | Dark attenuation rate (%) Before running test | Dark attenuation rate (%) After finish of 500-sheet image reprod. | Potential variation level (V) ΔVd | Potential variation level (V) ΔVl |
|---|---|---|---|---|---|---|
| 67 | 67 | No | 3.2 | 7.0 | +14 | +31 |
| 68 | 68 | No | 4.2 | 8.0 | +12 | +26 |

TABLE 6

| Comparative Example | Electrophotographic photosensitive member | Cracks in conductive layer | Dark attenuation rate (%) Before running test | Dark attenuation rate (%) After finish of 500-sheet image reprod. | Potential variation level (V) ΔVd | Potential variation level (V) ΔVl |
|---|---|---|---|---|---|---|
| 1 | C1 | No | 2.4 | 5.4 | +15 | +50 |
| 2 | C2 | No | 7.0 | 10.5 | +14 | +27 |
| 3 | C3 | No | 8.5 | 13.5 | +13 | +23 |
| 4 | C4 | No | 10.0 | 15.0 | +13 | +23 |
| 5 | C5 | No | 7.5 | 12.5 | +14 | +27 |
| 6 | C6 | No | 3.0 | 6.0 | +16 | +51 |
| 7 | C7 | No | 2.0 | 5.0 | +17 | +61 |
| 8 | C8 | No | 2.0 | 5.0 | +18 | +63 |
| 9 | C9 | No | 7.5 | 12.5 | +13 | +24 |
| 10 | C10 | No | 8.5 | 13.5 | +13 | +24 |
| 11 | C11 | No | 8.0 | 13.0 | +13 | +22 |
| 12 | C12 | No | 2.0 | 5.0 | +15 | +46 |
| 13 | C13 | Yes | 6.5 | 11.5 | +13 | +25 |
| 14 | C14 | No | 1.9 | 4.9 | +16 | +48 |
| 15 | C15 | Yes | 6.0 | 11.0 | +14 | +25 |
| 16 | C16 | No | 2.0 | 5.0 | +14 | +45 |
| 17 | C17 | No | 2.7 | 6.2 | +16 | +53 |
| 18 | C18 | No | 7.3 | 11.3 | +15 | +30 |
| 19 | C19 | No | 8.8 | 14.3 | +14 | +26 |
| 20 | C20 | No | 10.3 | 15.8 | +14 | +26 |
| 21 | C21 | No | 7.8 | 13.3 | +15 | +30 |
| 22 | C22 | No | 3.3 | 6.8 | +17 | +54 |
| 23 | C23 | No | 2.3 | 5.8 | +18 | +64 |
| 24 | C24 | No | 2.3 | 5.8 | +19 | +66 |
| 25 | C25 | No | 7.8 | 13.3 | +14 | +27 |
| 26 | C26 | No | 8.8 | 14.3 | +14 | +27 |
| 27 | C27 | No | 8.3 | 13.8 | +14 | +25 |
| 28 | C28 | No | 2.3 | 5.8 | +16 | +49 |
| 29 | C29 | Yes | 6.8 | 12.3 | +14 | +28 |
| 30 | C30 | No | 2.2 | 5.7 | +17 | +51 |
| 31 | C31 | Yes | 6.3 | 11.8 | +15 | +28 |
| 32 | C32 | No | 2.3 | 5.8 | +15 | +48 |
| 33 | C33 | No | 6.0 | 11.0 | +16 | +35 |
| 34 | C34 | No | 5.0 | 10.0 | +17 | +40 |
| 35 | C35 | No | 12.0 | 20.0 | +12 | +22 |
| 36 | C36 | No | 2.0 | 5.0 | +20 | +90 |
| 37 | C37 | No | 5.0 | 10.0 | +15 | +45 |
| 38 | C38 | No | 1.8 | 4.8 | +14 | +55 |
| 39 | C39 | Yes | 9.0 | 12.0 | +13 | +25 |
| 40 | C40 | No | 3.6 | 7.6 | +13 | +50 |
| 41 | C41 | Yes | 10.0 | 14.0 | +11 | +20 |
| 42 | C42 | No | 1.8 | 4.6 | +14 | +66 |
| 43 | C43 | No | 11.0 | 16.0 | +12 | +22 |
| 44 | C44 | No | 3.0 | 7.0 | +15 | +47 |
| 45 | C45 | No | 13.0 | 18.0 | +11 | +20 |
| 46 | C46 | No | 1.6 | 4.6 | +15 | +66 |
| 47 | C47 | No | 2.8 | 6.0 | +13 | +53 |
| 48 | C48 | Yes | 9.0 | 13.0 | +11 | +23 |
| 49 | C49 | No | 1.5 | 4.0 | +15 | +72 |
| 50 | C50 | No | 7.3 | 12.0 | +13 | +28 |
| 51 | C51 | No | 2.5 | 5.5 | +18 | +60 |
| 52 | C52 | No | 12.0 | 16.5 | +11 | +23 |

TABLE 6-continued

| Comparative Example | Electrophotographic photosensitive member | Cracks in conductive layer | Dark attenuation rate (%) Before running test | Dark attenuation rate (%) After finish of 500-sheet image reprod. | Potential variation level (V) ΔVd | Potential variation level (V) ΔVl |
|---|---|---|---|---|---|---|
| 53 | C53 | No | 6.5 | 10.2 | +13 | +29 |
| 54 | C54 | No | 1.6 | 4.6 | +17 | +71 |
| 55 | C55 | No | 8.5 | 11.0 | +13 | +25 |
| 56 | C56 | No | 2.5 | 5.5 | +17 | +58 |
| 57 | C57 | No | 10.5 | 15.5 | +12 | +22 |
| 58 | C58 | No | 2.6 | 5.8 | +15 | +58 |
| 59 | C58 | No | 11.5 | 16.0 | +11 | +20 |
| 60 | C60 | No | 3.7 | 7.0 | +13 | +48 |
| 61 | C61 | No | 2.1 | 5.6 | +15 | +58 |
| 62 | C62 | Yes | 9.3 | 12.8 | +14 | +28 |
| 63 | C63 | No | 3.9 | 8.4 | +14 | +53 |
| 64 | C64 | Yes | 10.3 | 14.8 | +12 | +23 |
| 65 | C65 | No | 2.1 | 5.4 | +15 | +69 |
| 66 | C66 | No | 11.3 | 16.8 | +13 | +25 |
| 67 | C67 | No | 3.3 | 7.8 | +16 | +50 |
| 68 | C68 | No | 13.3 | 18.8 | +12 | +23 |
| 69 | C69 | No | 1.9 | 5.4 | +16 | +69 |
| 70 | C70 | No | 3.1 | 6.8 | +14 | +56 |
| 71 | C71 | Yes | 9.3 | 13.8 | +12 | +26 |
| 72 | C72 | No | 1.8 | 4.8 | +16 | +75 |
| 73 | C73 | No | 7.6 | 12.8 | +14 | +31 |
| 74 | C74 | No | 2.8 | 6.3 | +19 | +63 |
| 75 | C75 | No | 12.3 | 17.3 | +12 | +26 |
| 76 | C76 | No | 6.8 | 11.0 | +14 | +32 |
| 77 | C77 | No | 1.9 | 5.4 | +18 | +74 |
| 78 | C78 | No | 8.8 | 11.8 | +14 | +28 |
| 79 | C79 | No | 2.8 | 6.3 | +18 | +60 |
| 80 | C80 | No | 10.8 | 16.3 | +13 | +25 |
| 81 | C81 | No | 2.9 | 6.6 | +16 | +61 |
| 82 | C82 | No | 11.8 | 16.8 | +12 | +23 |
| 83 | C83 | No | 4.0 | 7.8 | +14 | +51 |

Production Example of Electrophotographic Photosensitive Member 69

The procedure of Production Example of Electrophotographic Photosensitive Member 1 was repeated to form the conductive layer, the undercoat layer and the charge generation layer on the support in this order.

Next, 5.6 parts of the amine compound (charge-transporting material) represented by the formula (CT-1) and 2.4 parts of the amine compound represented by the formula (CT-2), 10 parts of polycarbonate (trade name: Z200; available from Mitsubishi Engineering-Plastics Corporation) and 0.36 part of a siloxane modified polycarbonate having a repeating structural unit represented by the following formula (B-1) and a repeating structural unit represented by the following formula (B-2) and having a terminal structure unit represented by the following formula (B-3) [(B-1):(B-2)=95:5 (molar ratio)]

(B-1)

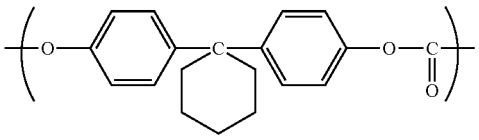

-continued (B-2)

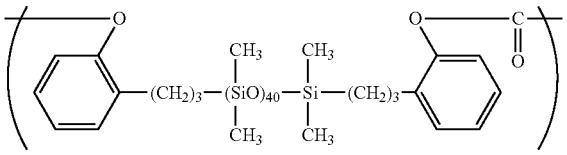

(B-3)

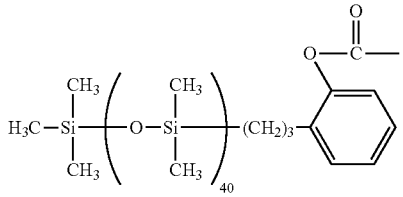

were dissolved in a mixed solvent of 60 parts of o-xylene, 40 parts of dimethoxymethane and 2.7 parts of methyl benzoate to prepare a coating liquid for charge transport layer. This coating liquid for charge transport layer was dip-coated on the charge generation layer, and then the wet coating formed was dried at 120° C. for 30 minutes to form a charge transport layer with a layer thickness of 7.0 μm.

Thus, an electrophotographic photosensitive member 69 was produced the charge transport layer of which was a surface layer.

Example 69

About the electrophotographic photosensitive member 69, measurement was made in the same way as Examples 1 to 68 and Comparative Examples 1 to 83 to find the value of dark attenuation rate before the sheet feeding durability test and that after the finish of the image reproduction on 500 sheets.

As the result, the dark attenuation rate before the sheet feeding durability test was 2.5%, and the dark attenuation rate after the finish of the image reproduction on 500 sheets was 5.5%. The dark area potential variation level ΔVd was +12 V, and the light area potential variation level ΔVl was +25 V.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-046518, filed Mar. 3, 2011, Japanese Patent Application No. 2011-215135, filed Sep. 29, 2011 and Japanese Patent Application No. 2012-039026, filed Feb. 24, 2012 which are hereby incorporated by reference herein in their entirety.

The invention claimed is:

1. A process for producing an electrophotographic photosensitive member;

the process comprising: the step of forming a conductive layer, having a volume resistivity of from $1.0\times10^{8}$ Ω·cm or more to $5.0\times10^{12}$ Ω·cm or less, on a support, and the step of forming a photosensitive layer on the conductive layer, wherein;

the step of forming the conductive layer comprises:

the step of preparing a coating liquid for the conductive layer by use of a solvent, a binder material and a metal oxide particle, and the step of forming the conductive layer by use of the coating liquid for the conductive layer;

the metal oxide particle (P) and the binder material (B) in the coating liquid for the conductive layer are in a mass ratio (P/B) of from 1.5/1.0 to 3.5/1.0;

the metal oxide particle is a titanium oxide particle coated with tin oxide doped with phosphorus or a titanium oxide particle coated with tin oxide doped with tungsten; and where powder resistivity of the metal oxide particle is represented by x (Ω·cm) and powder resistivity of the titanium oxide particle as a core particle constituting the metal oxide particle is represented by y (Ω·cm), the y and the x satisfy the following relations (i) and (ii):

$$5.0\times10^{7}\leq y\leq5.0\times10^{9} \quad \text{(i)}$$

$$1.0\times10^{2}\leq y/x\leq1.0\times10^{6} \quad \text{(ii).}$$

2. The process for producing an electrophotographic photosensitive member according to claim 1, wherein the metal oxide particle is a titanium oxide particle coated with tin oxide doped with phosphorus.

3. The process for producing an electrophotographic photosensitive member according to claim 1, wherein the metal oxide particle is a titanium oxide particle coated with tin oxide doped with tungsten.

4. The process for producing an electrophotographic photosensitive member according to claim 1, wherein the y and the x satisfy the following relation (iii):

$$1.0\times10^{3}\leq y/x\leq1.0\times10^{5} \quad \text{(iii).}$$

5. An electrophotographic photosensitive member, comprising:

a support;

a conductive layer, having a volume resistivity of from $1.0\times10^{8}$ Ω·cm or more to $5.0\times10^{12}$ Ω·cm or less, formed on the support; and a photosensitive layer formed on the conductive layer;

wherein;

the conductive layer comprises a binder material and a metal oxide particle, the metal oxide particle (P) and the binder material (B) in the conductive layer are in a mass ratio (P/B) of from 1.5/1.0 to 3.5/1.0, the metal oxide particle is a titanium oxide particle coated with tin oxide doped with phosphorus or a titanium oxide particle coated with tin oxide doped with tungsten, and where powder resistivity of the metal oxide particle is represented by x (Ω·cm) and powder resistivity of the titanium oxide particle as a core particle constituting the metal oxide particle is represented by y (Ω·cm), the y and the x satisfy the following relations (i) and (ii):

$$5.0\times10^{7}\leq y\leq5.0\times10^{9} \quad \text{(i)}$$

$$1.0\times10^{2}\leq y/x\leq1.0\times10^{6} \quad \text{(ii).}$$

* * * * *